US010253777B2

(12) United States Patent
Sakaguchi et al.

(10) Patent No.: US 10,253,777 B2
(45) Date of Patent: Apr. 9, 2019

(54) THREAD GROOVE PUMP MECHANISM, VACUUM PUMP INCLUDING THREAD GROOVE PUMP MECHANISM, AND ROTOR, OUTER CIRCUMFERENCE SIDE STATOR, AND INNER CIRCUMFERENCE SIDE STATOR USED IN THREAD GROOVE PUMP MECHANISM

(71) Applicant: Edwards Japan Limited, Yachiyo-shi, Chiba (JP)

(72) Inventors: Yoshiyuki Sakaguchi, Yachiyo (JP); Akihiko Wada, Yachiyo (JP); Takashi Kabasawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 300 days.

(21) Appl. No.: 15/021,499

(22) PCT Filed: Sep. 1, 2014

(86) PCT No.: PCT/JP2014/072913
§ 371 (c)(1),
(2) Date: Mar. 11, 2016

(87) PCT Pub. No.: WO2015/045748
PCT Pub. Date: Apr. 2, 2015

(65) Prior Publication Data

US 2016/0222971 A1 Aug. 4, 2016

(30) Foreign Application Priority Data

Sep. 30, 2013 (JP) ..... 2013-205599
Jan. 31, 2014 (JP) ..... 2014-016476

(51) Int. Cl.
*F04D 19/04* (2006.01)

(52) U.S. Cl.
CPC ..... *F04D 19/042* (2013.01); *F04D 19/044* (2013.01); *F04D 19/046* (2013.01)

(58) Field of Classification Search
CPC ..... F04D 19/042; F04D 19/044; F04D 19/046
See application file for complete search history.

(56) References Cited

U.S. PATENT DOCUMENTS 6,779,969 B2 * 8/2004 Nonaka ..... F04D 19/046 415/143

FOREIGN PATENT DOCUMENTS

DE 4113122 A1 * 10/1991 ..... F04D 19/044
EP 1318309 A2 6/2003
(Continued)

OTHER PUBLICATIONS

DE 4113122 A1—Translation and Original from Espacenet.*
(Continued)

*Primary Examiner* — Justin Seabe
*Assistant Examiner* — Behnoush Haghighian
(74) *Attorney, Agent, or Firm* — Westman, Champlin & Koehler, P.A.; Theodore M. Magee

(57) ABSTRACT

The present invention provides a thread groove pump mechanism which suppresses a backflow of the gas in the thread groove pump mechanism and reduces the pressure difference in the pump radial direction near the outlet of the thread groove pump mechanism to thereby improve the exhaust performance and the compression performance. The present invention also provides a vacuum pump including the thread groove pump mechanism, and a rotor, an outer circumference side stator, and an inner circumference side stator used in the thread groove pump mechanism. A thread groove pump mechanism includes an exhaust-performance improving means in an outer-circumference-side thread groove portion engraved on an opposite surface of an outer
(Continued)

circumference side stator opposed to a rotor cylinder portion and an inner-circumference-side thread groove portion engraved on an opposite surface of an inner circumference side stator opposed to the rotor cylinder portion.

17 Claims, 13 Drawing Sheets

(56) References Cited

FOREIGN PATENT DOCUMENTS

| | | | | |
|---|---|---|---|---|
| JP | H046593 | U | | 1/1992 |
| JP | H0538389 | U | | 5/1993 |
| JP | H0542695 | U | | 6/1993 |
| JP | 2003028090 | A | * | 1/2003 |
| JP | 2003065281 | A | | 3/2003 |
| JP | 2003172289 | A | | 6/2006 |
| WO | 2012043035 | A1 | | 4/2012 |

OTHER PUBLICATIONS

JP 2003028090—Translation and Original from Espacenet.*
Communication dated Mar. 17, 2017 and Supplementary European Search Report dated Mar. 9, 2017 for corresponding European Application No. EP14849788.
PCT International Search Report dated Nov. 18, 2014 for corresponding PCT Application No. PCT/JP2014/072913.

* cited by examiner

THREAD GROOVE PUMP MECHANISM, VACUUM PUMP INCLUDING THREAD GROOVE PUMP MECHANISM, AND ROTOR, OUTER CIRCUMFERENCE SIDE STATOR, AND INNER CIRCUMFERENCE SIDE STATOR USED IN THREAD GROOVE PUMP MECHANISM

CROSS-REFERENCE TO RELATED APPLICATION

This Application is a Section 371 National Stage Application of International Application No. PCT/JP2014/072913, filed Sep. 1, 2014, which is incorporated by reference in its entirety and published as WO 2015/045748 A1 on Apr. 2, 2015 and which claims priority of Japanese Application No. 2013-205599, filed Sep. 30, 2013 and Japanese Application No. 2014-016476, filed Jan. 31, 2014.

BACKGROUND OF THE INVENTION

1. Field of the Invention

The present invention relates to a thread groove pump mechanism of a vacuum pump, a vacuum pump including the thread groove pump mechanism, and a rotor, an outer circumference side stator, and an inner circumference side stator used in the thread groove pump mechanism and, more particularly, to a thread groove pump mechanism of a vacuum pump usable in a pressure range of medium vacuum to ultra-high vacuum, a vacuum pump including the thread groove pump mechanism, and a rotor, an outer circumference side stator, and an inner circumference side stator used in the thread groove pump mechanism.

2. Description of the Related Art

When a semiconductor device such as a memory or an integrated circuit is manufactured, it is necessary to perform doping and etching on a high-purity semiconductor substrate (wafer) in a chamber in a high vacuum state in order to avoid influence due to dust and the like in the air. A vacuum pump such as a turbo molecular pump is used for exhaust in the chamber.

As a vacuum pump used conventionally, there is known a combination pump including a turbo molecular pump mechanism A and a thread groove pump mechanism 200 provided below the turbo molecular pump A as shown in FIG. 10. The thread groove pump mechanism 200 includes a substantially cylindrical stator 202 disposed coaxially with a substantially cylindrical casing 201, a rotor 203 including a rotor shaft 203*a* turnably supported coaxially with the stator 202 and a substantially cylindrical cylinder portion 203*b* disposed between a casing 201 and a stator 202, and a plurality of thread groove portions 204 engraved on the inner circumferential surface of the stator 202 opposed to the cylinder portion 203*b*.

In such a vacuum pump, when a gas exhaust flow rate of gas compressed by the thread groove pump mechanism 200 increases, the exhaust performance of the thread groove pump mechanism 200 tends to be deteriorated. Therefore, as a vacuum pump for improving the exhaust performance of the thread groove pump mechanism, there is known a vacuum pump including a co-flow thread groove pump mechanism including an outer-circumference-side thread groove portion provided between a stator and a cylinder portion and an inner-circumference-side thread groove portion provided between the stator and the cylinder portion (see, for example, Japanese Utility Model Application Publication No. H5-38389).

In the vacuum pump including such a co-flow thread groove pump mechanism, gas transferred into the thread groove pump mechanism is distributed to an outer-circumference-side thread groove portion 90 and an inner-circumference-side thread groove portion 91 provided in parallel in a pump radial direction R as shown in FIG. 11. According to a drag effect due to high-speed rotation of a cylinder portion 92 relative to a casing 93 and a stator 94, the gas in the outer-circumference-side thread groove portion 90 and the gas in the inner-circumference-side thread groove portion 91 are transferred from an intake side to an exhaust side in an up-down direction H while being respectively compressed.

If the exhaust performance and the compression performance of the outer-circumference-side thread groove portion 90 and the exhaust performance and the compression performance of the inner-circumference-side thread groove portion 91 are equivalent, the gas exhaust amount of the outer-circumference-side thread groove portion 90 and the gas exhaust amount of the inner-circumference-side thread groove portion 91 are equal and the outlet pressure of the outer-circumference-side thread groove portion 90 and the outlet pressure of the inner-circumference-side thread groove portion 91 are equal. Therefore, the co-flow thread groove pump mechanism in which the outer-circumference-side thread groove portion 90 and the inner-circumference-side thread groove portion 91 are provided in parallel can exhibit double compression performance compared with a thread groove pump mechanism in which only one row of a thread groove portion is provided.

However, in the vacuum pump, a rotation radius of the gas in the inner-circumference-side thread groove portion 91 is smaller than a rotation radius of the gas in the outer-circumference-side thread groove portion 90. A centrifugal force acting on the gas in the inner-circumference-side thread groove portion 91 according to high-speed rotation of the cylinder portion 92 is smaller than a centrifugal force acting on the gas in the outer-circumference-side thread groove portion 90. Therefore, as indicated by arrows I in FIG. 11, a part of the gas in the inner-circumference-side thread groove portion 91 easily flows back from the exhaust side toward the intake side in a gap between the cylinder portion 92 and the stator 94. Therefore, a gas exhaust amount Q2 of the inner-circumference-side thread groove portion 91 markedly decreases compared with a gas exhaust amount Q1 of the outer-circumference-side thread groove portion 90. The gas exhaust amount Q1 of the outer-circumference-side thread groove portion 90 increases by an amount of the decrease in the gas exhaust amount Q2. It is likely that the exhaust performance and the compression performance of the co-flow thread groove pump mechanism are deteriorated.

The circumferential speed of the gas in the inner-circumference-side thread groove portion 91 is lower than the circumferential speed of the gas in the outer-circumference-side thread groove portion 90. A channel of the inner-circumference-side thread groove portion 91 is shorter than a channel of the outer-circumference-side thread groove portion 90. Therefore, the outlet pressure of the inner-circumference-side thread groove portion 91 is sometimes smaller than the outlet pressure of the outer-circumference-side thread groove portion 90. Consequently, a pressure difference occurs between the outer circumference side and the inner circumference side of the pump radial direction R near an outlet of the thread groove pump mechanism. It is difficult for the inner-circumference-side thread groove portion 91 to compress and exhaust the gas. It is likely that the exhaust performance and the compression performance of the co-flow thread groove pump mechanism are further deteriorated.

Specifically, in the intake side of the thread groove pump mechanism, as indicated by a back pressure characteristic shown in FIG. 12, since fluctuation occurs in exhaust side pressure (back pressure) between the outer circumference side and the inner circumference side, the gas divided to the outer-circumference-side thread groove portion 90 and the inner-circumference-side thread groove portion 91 and respectively compressed at the same intake side pressure flows back from the outer-circumference-side thread groove portion 90 or the inner-circumference-side thread groove portion 91 having smaller exhaust side pressure to the outer-circumference-side thread groove portion 90 or the inner-circumference-side thread groove portion 91 having larger exhaust side pressure. It is likely that the exhaust performance and the compression performance of the thread groove pump mechanism are further deteriorated.

Further, when the co-flow thread groove pump mechanism and a thread groove pump mechanism including one row of a thread groove portion capable of exhausting gas at a flow rate same as the flow rate of the co-flow thread groove pump mechanism are compared, the exhaust side pressure of the former tends to markedly rise. In a higher back pressure region than pressure P in FIG. 13, the exhaust performance of the former is lower than the exhaust performance of the latter. The inner-circumference-side thread groove portion does not function.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

Therefore, there is a technical problem that should be solved in order to improve the exhaust performance and the compression performance of the co-flow thread groove pump mechanism. An object of the present invention is to solve the problem.

The present invention is proposed to attain the object. According to a first aspect of the present invention, there is provided a thread groove pump mechanism including: a rotor cylinder portion rotatable in a predetermined rotating direction; an outer circumference side stator having a substantially cylindrical shape and disposed coaxially with the rotor cylinder portion on an outer circumference side of the rotor cylinder portion; an inner circumference side stator having a substantially cylindrical shape and disposed coaxially with the rotor cylinder portion on an inner circumference side of the rotor cylinder portion; an outer-circumference-side thread groove portion engraved on one of opposite surfaces of the rotor cylinder portion and the outer circumference side stator; and an inner-circumference-side thread groove portion engraved on one of opposite surfaces of the rotor cylinder portion and the inner circumference side stator. An exhaust-performance improving means is provided in the outer-circumference-side thread groove portion or the inner-circumference-side thread groove portion.

With this configuration, the exhaust-performance improving means suppresses a backflow of gas in the thread groove pump mechanism and reduces a pressure difference in a pump radial direction in an outlet of the thread groove pump mechanism, whereby it is possible to improve the exhaust performance and the compression performance of the thread groove pump mechanism.

According to a second aspect of the present invention, in addition to the configuration of the thread groove pump mechanism according to the first aspect, the rotor cylinder portion is provided in a rotor, and the exhaust-performance improving means is configured such that a ratio of a root width of the inner-circumference-side thread groove portion and a ridge width of an inner-circumference-side thread ridge portion extended between the inner-circumference-side thread groove portions is set to be smaller than a ratio of a root width of the outer-circumference-side thread groove portion and a ridge width of an outer-circumference-side thread ridge portion extended between the outer-circumference-side thread groove portions.

With this configuration, the ridge width of the inner-circumference-side thread ridge portion is set to be longer than the ridge width of the outer-circumference-side thread ridge portion. A seal length of the inner-circumference-side thread ridge portion, that is, the length in the up-down direction of the inner-circumference-side thread ridge portion is set to be larger than a seal length of the outer-circumference-side thread ridge portion, that is, the length in the up-down direction of the outer-circumference-side thread ridge portion. Therefore, since sealability between the rotor cylinder portion and the inner circumference side stator is increased, it is possible to suppress the gas in the inner-circumference-side thread groove portion from flowing back in a gap between the rotor cylinder portion and the inner circumference side stator.

The root width of the inner-circumference-side thread groove portion is set to be shorter than the root width of the outer-circumference-side thread groove portion. A channel sectional area of the inner-circumference-side thread groove portion is narrower than a channel sectional area of the outer-circumference-side thread groove portion. Therefore, since a compression ratio of the inner-circumference-side thread groove portion, which less easily compresses the gas compared with the outer-circumference-side thread groove portion, increases, a pressure difference between the outer circumference side and the inner circumference side in the pump radial direction near the outlet of the thread groove pump mechanism is reduced. It is possible to make it easy for the inner-circumference-side thread groove portion to compress and exhaust the gas. That is, the sealability between the rotor cylinder portion and the inner circumference side stator increases. A backflow of the gas in the inner-circumference-side thread groove portion is suppressed. The pressure difference in the pump radial direction near the outlet of the thread groove pump mechanism is reduced. The inner-circumference-side thread groove portion easily compresses and exhausts the gas. Therefore, it is possible to improve the exhaust performance and the compression performance of the co-flow thread groove pump mechanism.

According to a third aspect of the present invention, in addition to the configuration of the thread groove pump mechanism according to the second aspect, a ratio of the ratio of the root width of the inner-circumference-side thread groove portion and the ridge width of the inner-circumference-side thread ridge portion and the ratio of the root width of the outer-circumference-side thread groove portion and the ridge width of the outer-circumference-side thread ridge portion substantially coincides with a ratio of a gas exhaust flow rate of the outer-circumference-side thread groove portion and a gas exhaust flow rate of the inner-circumference-side thread groove portion.

With this configuration, the seal length of the inner-circumference-side thread ridge portion is secured. Therefore, the sealability between the rotor cylinder portion and the inner circumference side stator is improved. The channel sectional area of the outer-circumference-side thread groove portion and the channel sectional area of the inner-circumference-side thread groove portion are set according to the gas exhaust flow rate of the outer-circumference-side thread groove portion and the gas exhaust flow rate of the inner-circumference-side thread groove portion such that the gas is surely distributed to the outer-circumference-side thread groove portion and the inner-circumference-side thread groove portion. Therefore, the outer-circumference-side thread groove portion and the inner-circumference-side thread groove portion can smoothly compress and exhaust the gas.

According to a fourth aspect of the present invention, in addition to the configuration of the thread groove pump mechanism according to the second or third aspect, the ratio of the root width of the inner-circumference-side thread groove portion and the ridge width of the inner-circumference-side thread ridge portion, and the ratio of the root width of the outer-circumference-side thread groove portion and the ridge width of the outer-circumference-side thread ridge portion satisfy a relational expression described below:

$$(A1/B1)/(A2/B2) \leq 3$$

A1: the root width of the outer-circumference-side thread groove portion

B1: the ridge width of the outer-circumference-side thread ridge portion

A2: the root width of the inner-circumference-side thread groove portion

B2: the ridge width of the inner-circumference-side thread ridge portion.

With this configuration, it is possible to suppress, while securing the seal length of the inner-circumference-side thread ridge portion, the gas exhaust flow rate of the inner-circumference-side thread groove portion from becoming excessively small.

According to a fifth aspect of the present invention, in addition to the configuration of the thread groove pump mechanism according to any one of the second to fourth aspects, the ratio of the root width of the inner-circumference-side thread groove portion and the ridge width of the inner-circumference-side thread ridge portion, and the ratio of the root width of the outer-circumference-side thread groove portion and the ridge width of the outer-circumference-side thread ridge portion satisfy a relational expression described below:

$$2 \leq (A1/B1)/(A2/B2)$$

A1: the root width of the outer-circumference-side thread groove portion

B1: the ridge width of the outer-circumference-side thread ridge portion

A2: the root width of the inner-circumference-side thread groove portion

B2: the ridge width of the inner-circumference-side thread ridge portion.

With this configuration, it is possible to secure, while securing the seal length of the inner-circumference-side thread ridge portion, the root width of the inner-circumference-side thread groove portion large. Therefore, the inner-circumference-side thread groove portion can smoothly compress and exhaust the gas.

According to a sixth aspect of the present invention, in addition to the configuration of the thread groove pump mechanism according to the first aspect, a plurality of the outer-circumference-side thread groove portions are engraved on at least one of an outer circumferential surface of the rotor cylinder portion and an opposite surface of the outer circumference side stator opposed to the outer circumferential surface of the rotor cylinder portion, a plurality of the inner-circumference-side thread groove portions are engraved on at least one of an inner circumferential surface of the rotor cylinder portion and an opposite surface of the inner circumference side stator opposed to the inner circumferential surface of the rotor cylinder portion, and the exhaust-performance improving means is configured such that a back pressure characteristic indicating a relation between an intake side pressure and an exhaust side pressure is set to be substantially equal for the plurality of the outer-circumference-side thread groove portions and the plurality of the inner-circumference-side thread groove portions.

With this configuration, the back pressure characteristic of the outer-circumference-side thread groove portion and the back pressure characteristic of the inner-circumference-side thread groove portion are set to be substantially equal. Therefore, a backflow of the gas between the outer-circumference-side thread groove portion and the inner-circumference-side thread groove portion on the intake side of the thread groove pump mechanism due to inconsistency of the intake side pressure of the outer-circumference-side thread groove portion and the intake side pressure of the inner-circumference-side thread groove portion is suppressed. A backflow of the gas between the outer-circumference-side thread groove portion and the inner-circumference-side thread groove portion on the exhaust side of the thread groove pump mechanism due to inconsistency of the exhaust side pressure of the outer-circumference-side thread groove portion and the exhaust side pressure of inner-circumference-side thread groove portion is suppressed. Consequently, since the outer-circumference-side thread groove portion and the inner-circumference-side thread groove portion respectively surely function from a low back pressure region to a high back pressure region, it is possible to improve the exhaust performance and the compression performance of the co-flow thread groove pump mechanism.

According to a seventh aspect of the present invention, in addition to the configuration of the thread groove pump mechanism according to the sixth aspect, an angle of elevation of an inner-circumference-side thread ridge portion extended between the plurality of the inner-circumference-side thread groove portions is set to be smaller than an angle of elevation of an outer-circumference-side thread ridge portion extended between the plurality of the outer-circumference-side thread groove portions.

With this configuration, a channel of the gas transferred from the intake side to the exhaust side of the inner-circumference-side thread groove portion is increased in length, a compression ratio of the inner-circumference-side thread groove portion is improved. Consequently, it is possible to improve the compression performance of the inner-circumference-side thread groove portion.

According to an eighth aspect of the present invention, in addition to the configuration of the thread groove pump mechanism according to the sixth or seventh aspect, the number of ridges of an inner-circumference-side thread ridge portion extended between the plurality of the inner-circumference-side thread groove portions is set to be larger than the number of ridges of an outer-circumference-side thread ridge portion extended between the plurality of the outer-circumference-side thread groove portions.

With this configuration, the gas is efficiently transferred from the intake side to the exhaust side of the inner-circumference-side thread groove portion. Therefore, the compression ratio of the inner-circumference-side thread groove portion is improved. Consequently, it is possible to improve the compression performance of the inner-circumference-side thread groove portion.

According to a ninth aspect of the present invention, in addition to the configuration of the thread groove pump mechanism according to any one of the sixth to eighth aspects, a groove depth of the inner-circumference-side thread groove portion is set to be smaller than a groove depth of the outer-circumference-side thread groove portion.

With this configuration, the gas transferred from the intake side to the exhaust side in the inner-circumference-side thread groove portion is less than the gas transferred from the intake side to the exhaust side in the outer-circumference-side thread groove portion. Therefore, the compression ratio of the inner-circumference-side thread groove portion is improved while the intake side pressure of the inner-circumference-side thread groove portion is maintained. Consequently, it is possible to improve the exhaust performance and the compression performance of the inner-circumference-side thread groove portion.

According to a tenth aspect of the present invention, in addition to the configuration of the thread groove pump mechanism according to any one of the sixth to ninth aspects, a clearance between an inner-circumference-side thread ridge portion extended between the plurality of the inner-circumference-side thread groove portions and the inner circumference side stator or the rotor cylinder portion is set to be smaller than a clearance between an outer-circumference-side thread ridge portion extended between the plurality of the outer-circumference-side thread groove portions and the outer circumference side stator or the rotor cylinder portion.

With this configuration, the gas in the inner-circumference-side thread groove portion is suppressed from leaking from the clearance between the inner circumference side stator or the rotor cylinder portion and the inner-circumference-side thread groove portion and flowing back to the intake side. Therefore, the compression ratio of the inner-circumference-side thread groove portion is improved while the intake side pressure of the inner-circumference-side thread groove portion is maintained. Consequently, it is possible to improve the exhaust performance and the compression performance of the inner-circumference-side thread groove portion.

According to an eleventh aspect of the present invention, in addition to the configuration of the thread groove pump mechanism according to any one of the sixth to tenth aspects, a total inlet area of the plurality of the inner-circumference-side thread groove portions is set to be larger than a total opening area of connection holes drilled in the rotor cylinder portion.

With this configuration, the gas smoothly flows into the intake side of the inner-circumference-side thread groove portion via a communication path. Therefore, an excessive pressure rise on the intake side of the inner-circumference-side thread groove portion is suppressed. Consequently, it is possible to improve the exhaust performance and the compression performance of the inner-circumference-side thread groove portion.

According to a twelfth aspect of the present invention, there is provided a vacuum pump including the thread groove pump mechanism according to any one of the first to eleventh aspects.

With this configuration, the exhaust performance and the compression performance of the thread groove pump mechanism are improved, whereby it is possible to improve the exhaust performance and the compression performance of the entire pump.

According to a thirteenth aspect of the present invention, there is provided a rotor used in the thread groove pump mechanism according to any one of the first to eleventh aspects.

With this configuration, a backflow of the gas on the intake side and the exhaust side of the thread groove pump mechanism applied with the rotor is suppressed, whereby it is possible to improve the exhaust performance and the compression performance of the thread groove pump mechanism.

According to a fourteenth aspect of the present invention, in addition to the configuration of the rotor according to the thirteenth aspect, a ratio of a root width of the outer-circumference-side thread groove portion and a ridge width of an outer-circumference-side thread ridge portion extended between the outer-circumference-side thread groove portions is set to be larger than a ratio of a root width of the inner-circumference-side thread groove portion engraved on one of the opposite surfaces of the rotor cylinder portion and the inner circumference side stator and a ridge width of an inner-circumference-side thread ridge portion extended between the inner-circumference-side thread groove portions.

With this configuration, the seal length of the inner-circumference-side thread ridge portion is set to be larger than the seal length of the outer-circumference-side thread ridge portion. Therefore, since the sealability between the rotor cylinder portion and the inner circumference side stator is increased, it is possible to suppress the gas in the inner-circumference-side thread groove portion from flowing back in the gap between the rotor cylinder portion and the inner circumference side stator. The channel sectional area of the inner-circumference-side thread groove portion is narrower than the channel sectional area of the outer-circumference-side thread groove portion. Therefore, since the compression ratio of the inner-circumference-side thread groove portion, which less easily compresses the gas compared with the outer-circumference-side thread groove portion, increases, the pressure difference between the outer circumference side and the inner circumference side in the pump radial direction near the outlet of the thread groove pump mechanism is reduced. It is possible to make it easy for the inner-circumference-side thread groove portion to compress and exhaust the gas.

According to a fifteenth aspect of the present invention, there is provided an outer circumference side stator used in the thread groove pump mechanism according to any one of the first to eleventh aspects.

With this configuration, a backflow of the gas on the intake side and the exhaust side of the thread groove pump mechanism applied with the outer circumference side stator is suppressed, whereby it is possible to improve the exhaust performance and the compression performance of the thread groove pump mechanism.

According to a sixteenth aspect of the present invention, in addition to the configuration of the outer circumference side stator according to the fifteenth aspect, a ratio of a root width of the outer-circumference-side thread groove portion and a ridge width of an outer-circumference-side thread ridge portion extended between the outer-circumference-side thread groove portions is set to be larger than a ratio of a root width of the inner-circumference-side thread groove portion engraved on one of the opposite surfaces of the rotor cylinder portion and the inner circumference side stator and a ridge width of an inner-circumference-side thread ridge portion extended between the inner-circumference-side thread groove portions.

With this configuration, the seal length of the inner-circumference-side thread ridge portion is set to be larger than the seal length of the outer-circumference-side thread ridge portion. Therefore, since the sealability between the rotor cylinder portion and the inner circumference side stator is increased, it is possible to suppress the gas in the inner-circumference-side thread groove portion from flowing back in the gap between the rotor cylinder portion and the inner circumference side stator. The channel sectional area of the inner-circumference-side thread groove portion is narrower than the channel sectional area of the outer-circumference-side thread groove portion. Therefore, since the compression ratio of the inner-circumference-side thread groove portion, which less easily compresses the gas compared with the outer-circumference-side thread groove portion, increases, the pressure difference between the outer circumference side and the inner circumference side in the pump radial direction near the outlet of the thread groove pump mechanism is reduced. It is possible to make it easy for the inner-circumference-side thread groove portion to compress and exhaust the gas.

According to a seventeenth aspect of the present invention, there is provided an inner circumference side stator used in the thread groove pump mechanism according to any one of the first to eleventh aspects.

With this configuration, a backflow of the gas on the intake side and the exhaust side of the thread groove pump mechanism applied with the inner circumference side stator is suppressed, whereby it is possible to improve the exhaust performance and the compression performance of the thread groove pump mechanism.

In the thread groove pump mechanism according to the present invention, a backflow of the gas in the thread groove pump mechanism is suppressed and the pressure difference in the pump radial direction near the outlet of the thread groove pump mechanism is reduced, whereby it is possible to improve the exhaust performance and the compression performance of the thread groove pump mechanism.

In the vacuum pump according to the present invention, the exhaust performance and the compression performance of the thread groove pump mechanism are improved, whereby it is possible to improve the exhaust performance and the compression performance of the entire pump.

The rotor of the thread groove pump mechanism according to the present invention suppresses a backflow of the gas in the thread groove pump mechanism and reduces the pressure difference in the pump radial direction near the outlet of the thread groove pump mechanism, whereby it is possible to improve the exhaust performance and the compression performance of the thread groove pump mechanism.

The outer circumference side stator of the thread groove pump mechanism according to the present invention suppresses a backflow of the gas in the thread groove pump mechanism and reduces the pressure difference in the pump radial direction near the outlet of the thread groove pump mechanism, whereby it is possible to improve the exhaust performance and the compression performance of the thread groove pump mechanism.

The inner circumference side stator of the thread groove pump mechanism according to the present invention suppresses a backflow of the gas in the thread groove pump mechanism and reduces the pressure difference in the pump radial direction near the outlet of the thread groove pump mechanism, whereby it is possible to improve the exhaust performance and the compression performance of the thread groove pump mechanism.

BRIEF DESCRIPTION OF THE DRAWINGS

FIGS. 2A to 2C are diagrams of an outer circumference side stator shown in FIG. 1, wherein FIG. 2A is a plan view, FIG. 2B is a IIB-line sectional view in FIG. 2A, and FIG. 2C is a IIC-line sectional enlarged view in FIG. 2B;

FIGS. 3A to 3C are diagrams of an inner circumference side stator shown in FIG. 1, wherein FIG. 3A is a plan view, FIG. 3B is a IIIB-line sectional view in FIG. 3A, and FIG. 3C is a IIIC-line sectional enlarged view in FIG. 3B;

FIGS. 5A to 5C are diagrams of an outer circumference side stator shown in FIG. 4, wherein FIG. 5A is a plan view, FIG. 5B is a VB-line sectional view in FIG. 5A, and FIG. 5C is a VC-line sectional enlarged view in FIG. 5B;

FIGS. 6A to 6C are diagrams of an inner circumference side stator shown in FIG. 4, wherein FIG. 6A is a plan view, FIG. 6B is a VIB-line sectional view in FIG. 6A, and FIG. 6C is a VIC-line sectional enlarged view in FIG. 6B;

DETAILED DESCRIPTION

Figure 1:
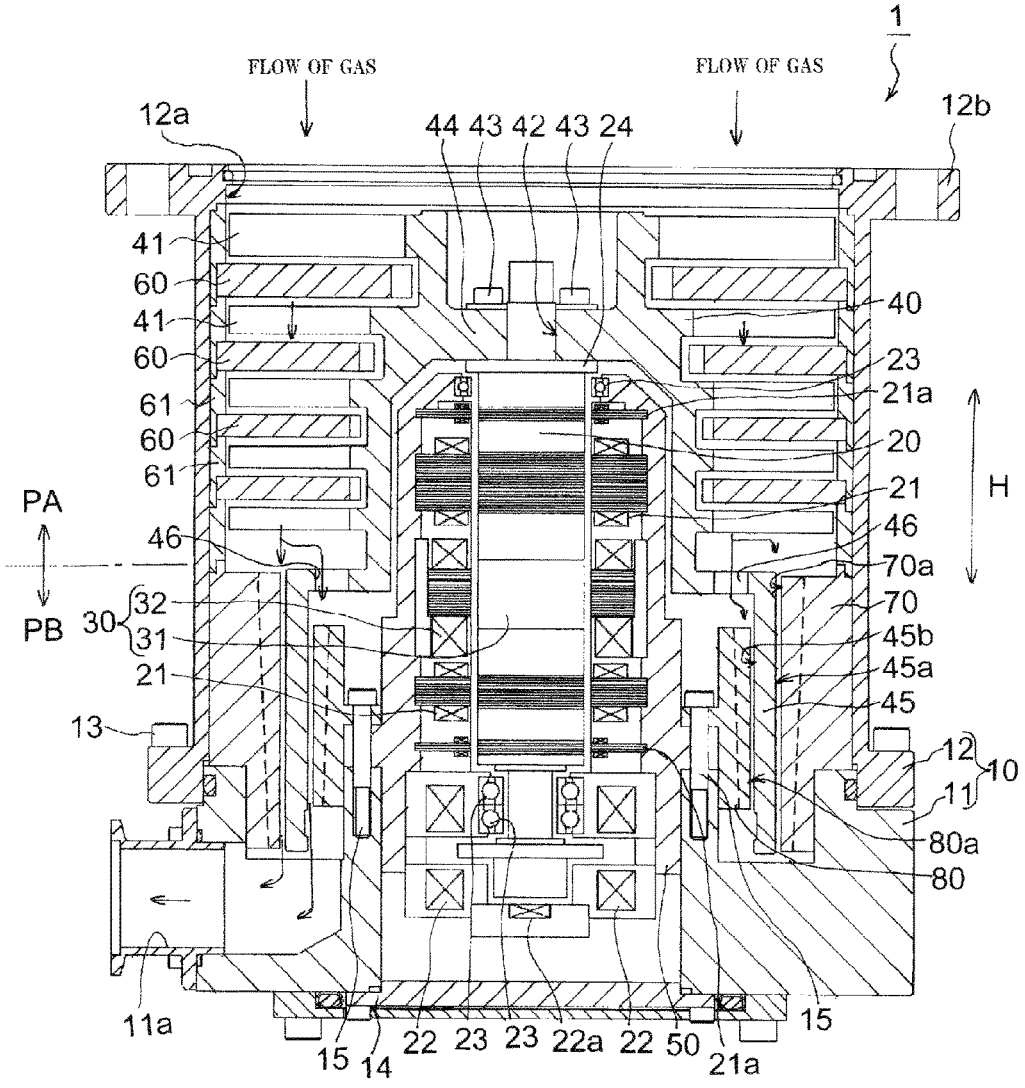
FIG. 1 is a sectional view showing a vacuum pump including a thread groove pump mechanism according to a first embodiment of the present invention.
Figure 2:
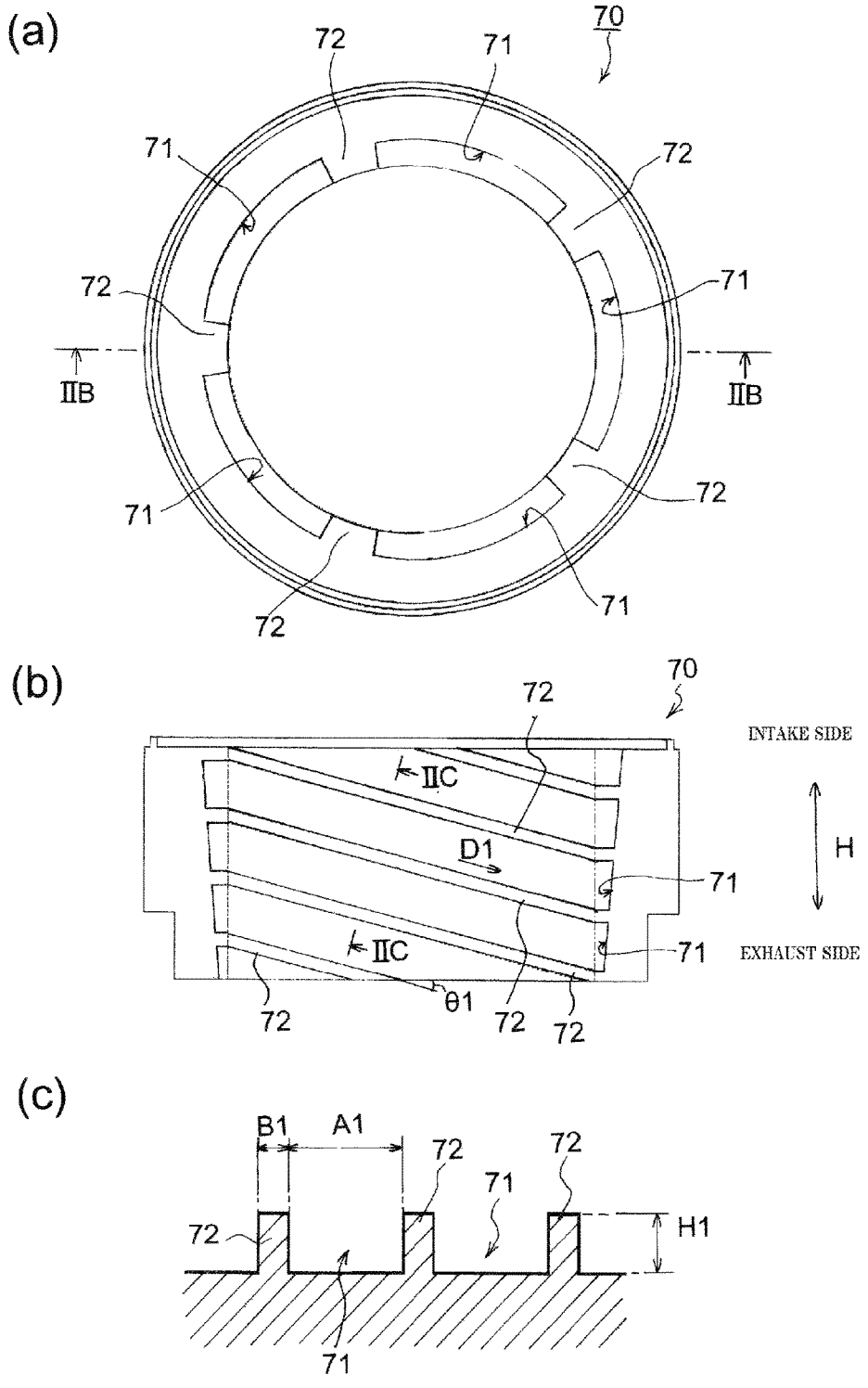
Figure 3:
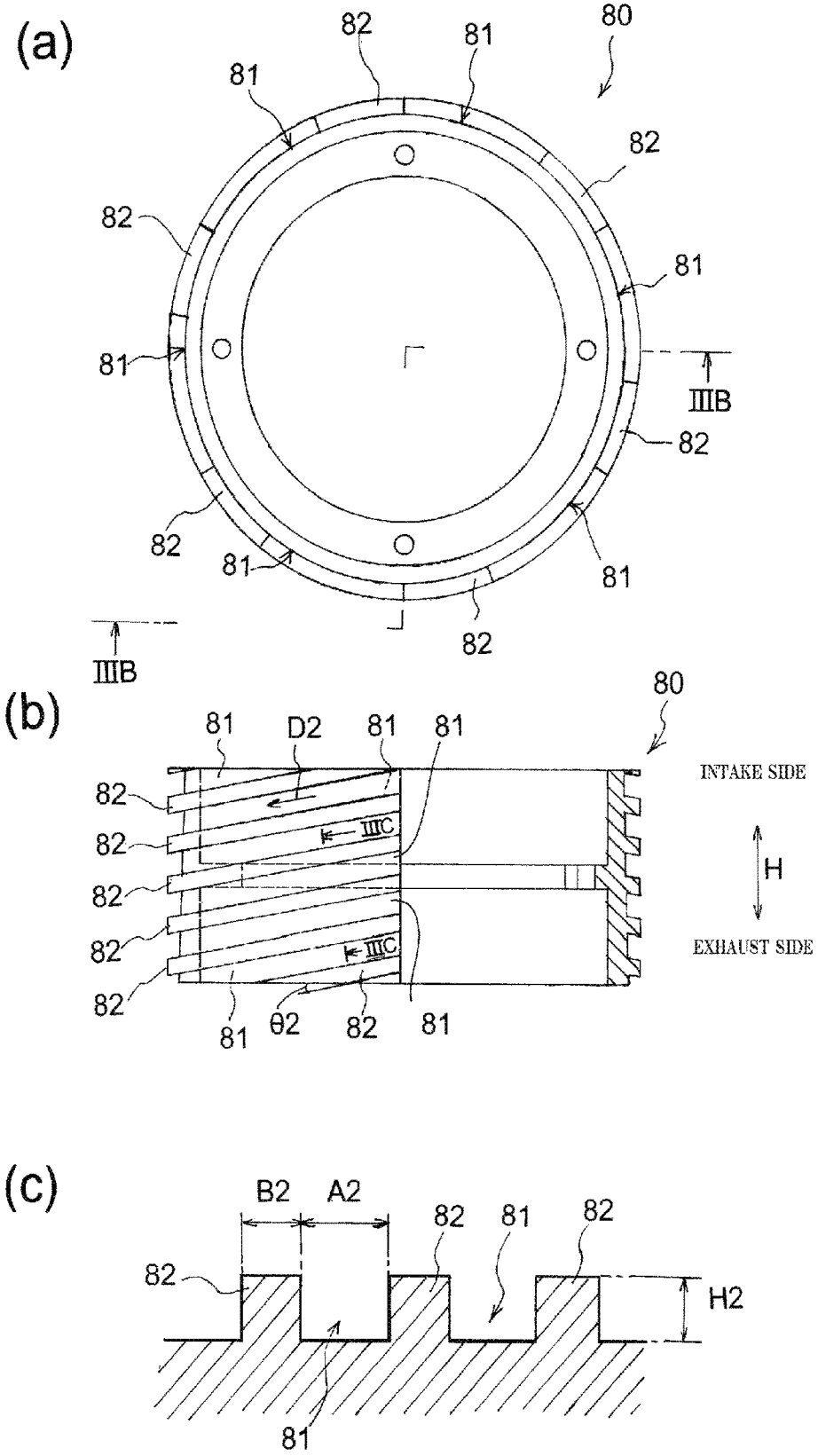
Figure 4:
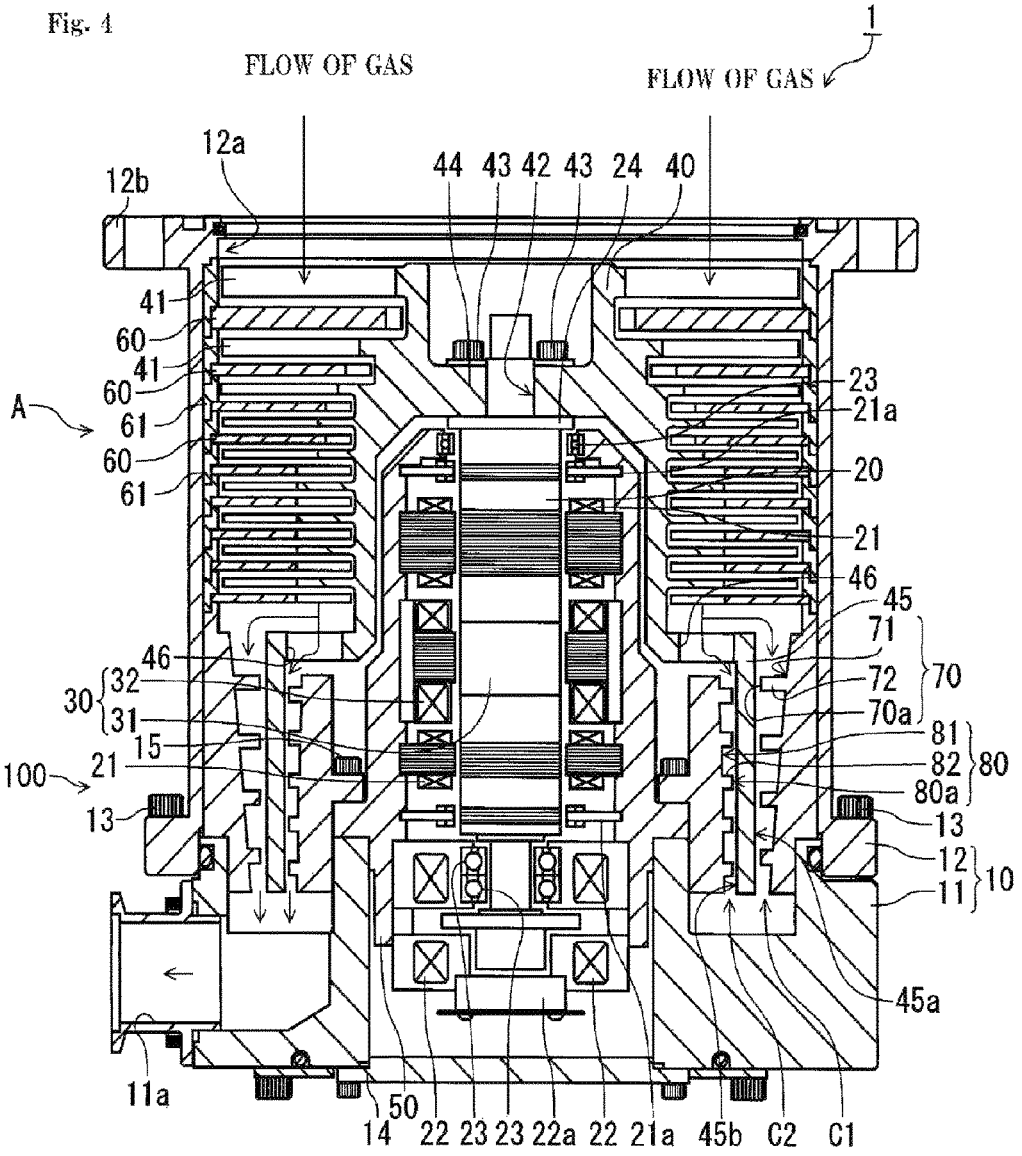
FIG. 4 is a sectional view showing a vacuum pump including a thread groove pump mechanism according to a second embodiment of the present invention.
Figure 5:
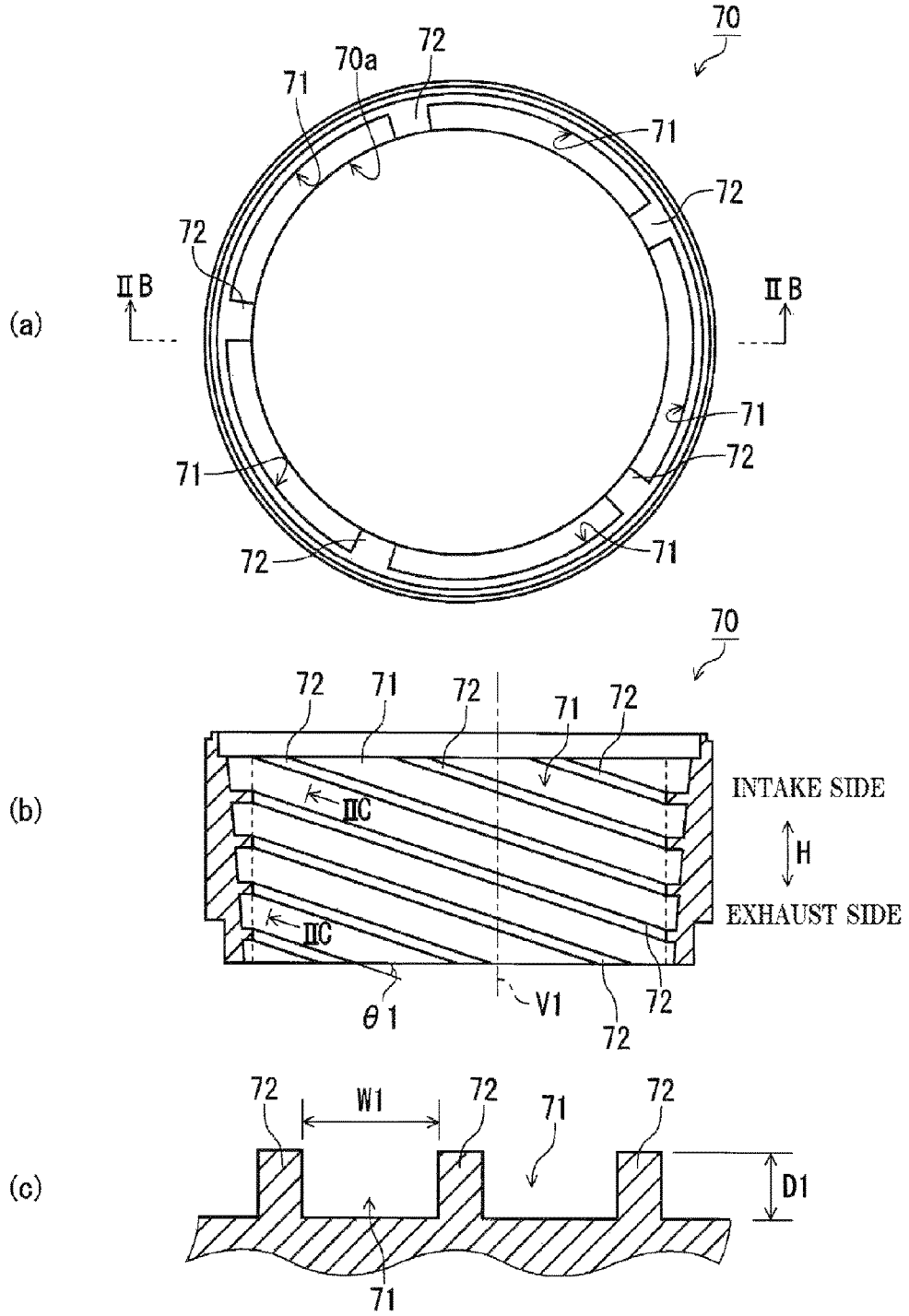
Figure 6:
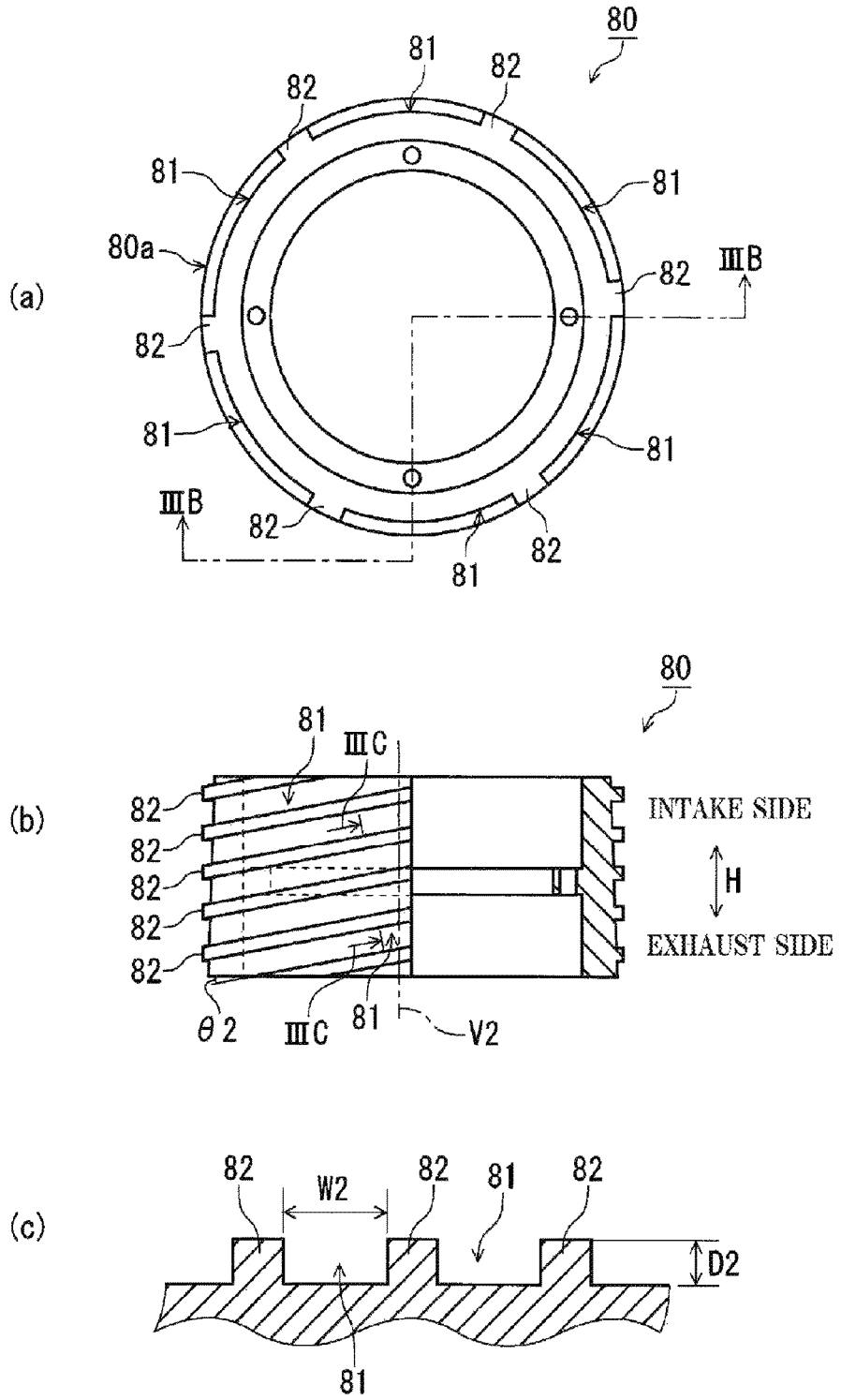

In order to attain the purpose of improving the exhaust performance and the compression performance of a thread groove pump mechanism, the present invention is realized by a thread groove pump mechanism including a rotor cylinder portion rotatable in a predetermined rotating direction, an outer circumference side stator having a substantially cylindrical shape and disposed coaxially with the rotor cylinder portion on an outer circumference side of the rotor cylinder portion, an inner circumference side stator having a substantially cylindrical shape and disposed coaxially with the rotor cylinder portion on an inner circumference side of the rotor cylinder portion, an outer-circumference-side thread groove portion engraved on one of opposite surfaces of the rotor cylinder portion and the outer circumference side stator, and an inner-circumference-side thread groove portion engraved on one of opposite surfaces of the rotor cylinder portion and the inner circumference side stator. An exhaust-performance improving means is provided in the outer-circumference-side thread groove portion or the inner-circumference-side thread groove portion.

Embodiments

A vacuum pump including a thread groove pump mechanism according to a first embodiment of the present invention is explained below with reference to FIGS. 1 to 3C.

A vacuum pump 1 is a combination pump including a turbo molecular pump mechanism PA and a thread groove pump mechanism PB housed in a substantially cylindrical casing 10.

The vacuum pump 1 includes the substantially cylindrical casing 10, a rotor shaft 20 rotatably supported in the casing 10, a driving motor 30 that rotates the rotor shaft 20, a rotor 40 fixed in an upper part of the rotor shaft 20 and including rotary blades 41 provided in parallel concentrically with respect to the axis of the rotor shaft 20, and a stator column 50 that houses a part of the rotor shaft 20 and the driving motor 30.

The casing 10 is formed in a bottomed cylindrical shape. The casing 10 is configured by a base 11 in which a gas outlet port 11*a* is formed in a lower side part thereof and a cylinder portion 12 in which a gas inlet port 12*a* is formed in an upper part thereof. The cylinder portion 12 is fixed via bolts 13 in a state in which the cylinder portion 12 is placed on the base 11. Note that reference numeral 14 in FIG. 1 denotes a rear cover.

The casing 10 is attached to a not-shown vacuum container such as a chamber via a flange 12*b* of the cylinder portion 12. The gas inlet port 12*a* is connected to the vacuum container. The gas outlet port 11*a* is connected to a not-shown auxiliary pump to communicate with the auxiliary pump.

The rotor shaft 20 is supported in a non-contact manner by a radial electromagnet 21 and an axial electromagnet 22. The radial electromagnet 21 and the axial electromagnet 22 are connected to a not-shown control unit.

The control unit controls excitation currents for the radial electromagnet 21 and the axial electromagnet 22 on the basis of detection values of a radial direction displacement sensor 21*a* and an axial direction displacement sensor 22*a*. Consequently, the rotor shaft 20 is supported in a state in which the rotor shaft 20 floats in a predetermined position.

An upper part and a lower part of the rotor shaft 20 are inserted through a touchdown bearing 23. When the rotor shaft 20 becomes uncontrollable, the rotor shaft 20 rotating at high speed comes into contact with the touchdown bearing 23 to prevent damages to the vacuum pump 1.

The driving motor 30 is configured by a rotator 31 attached to the outer circumference of the rotor shaft 20 and a stator 32 disposed to surround the rotator 31. The stator 32 is connected to the not-shown control unit. The rotation of the rotor shaft 20 and the rotor 40 is controlled by the control unit.

In a state in which the upper part of the rotor shaft 20 is inserted through a boss hole 42, the rotor 40 is integrally attached to the rotor shaft 20 by inserting bolts 43 through a rotor flange 44 and screwing the bolts 43 in a shaft flange 24.

The lower end portion of the stator column 50 is fixed to the base 11 via not-shown bolts in a state in which the stator column 50 is placed on the base 11.

Next, the turbo molecular pump mechanism PA disposed in a substantially upper half of the vacuum pump 1 is explained.

The turbo molecular pump mechanism PA is configured by the rotary blades 41 of the rotor 40, and fixed blades 60 each disposed between the rotary blades 41, spaced apart from the rotary blades 41. The rotary blades 41 and the fixed blades 60 are alternately arrayed in multiple stages along an up-down direction H. In this embodiment, the rotary blades 41 are arrayed in five stages and the fixed blades 60 are arrayed in four stages.

The rotary blades 41 are formed by blades inclining at a predetermined angle and are integrally formed on an upper outer circumferential surface of the rotor 40. A plurality of the rotary blades 41 are radially set around the axis of the rotor 40.

The fixed blades 60 are formed by blades inclining in a direction opposed to a direction in which the rotary blades 41 incline. The fixed blades 60 are sandwiched by spacers 61, which are set to be stacked on the inner wall surface of the cylinder portion 12, and positioned. A plurality of the fixed blades 60 are also radially set around the axis of the rotor 40.

Gaps between the rotary blades 41 and the fixed blades 60 are set to gradually decrease from the top toward the bottom in the up-down direction H. Lengths of the rotary blades 41 and the fixed blades 60 are set to gradually decrease from the top toward the bottom in the up-down direction H.

The turbo molecular pump mechanism PA explained above is configured to transfer the gas, which is sucked from the gas inlet port 12*a*, from the top to the bottom in the up-down direction H according to the rotation of the rotary blades 41.

Next, the thread groove pump mechanism PB disposed in a substantially lower half of the vacuum pump 1 is explained.

The thread groove pump mechanism PB includes a rotor cylinder portion 45 provided in a lower part of the rotor 40 and extending along the up-down direction H, an outer circumference side stator 70 having a substantially cylindrical shape and disposed to surround an outer circumferential surface 45*a* of the rotor cylinder portion 45, an inner circumference side stator 80 having a substantially cylindrical shape and disposed in the rotor cylinder portion 45, and an exhaust-performance improving means explained below.

The outer circumferential surface 45*a* and an inner circumferential surface 45*b* of the rotor cylinder portion 45 are formed as plane cylinder surfaces. The outer circumferential surface 45*a* of the rotor cylinder portion 45 is opposed to an inner circumferential surface 70*a*, which is an opposite surface of the outer circumference side stator 70 opposed to the outer circumferential surface 45*a* of the rotor cylinder portion 45, via a predetermined gap. The inner circumferential surface 45*b* of the rotor cylinder portion 45 is opposed to an outer circumferential surface 80*a*, which is an opposite surface of the inner circumference side stator 80 opposed to the inner circumferential surface 45*b* of the rotor cylinder portion 45, via a predetermined gap.

The outer circumference side stator 70 is fixed to the base 11 via not-shown bolts. The outer circumference side stator 70 includes an outer-circumference-side thread groove portion 71 engraved on the inner circumferential surface 70*a*.

The inner circumference side stator 80 is fixed to the base 11 via bolts 15. The inner circumference side stator 80 includes an inner-circumference-side thread groove portion 81 engraved on the outer circumferential surface 80*a*.

The thread groove pump mechanism PB explained above compresses, with a drag effect by high-speed rotation of the rotor cylinder portion 45, the gas transferred downward in the up-down direction H from the gas inlet port 12*a* and transfers the gas toward the gas outlet port 11*a*.

Specifically, the gas is transferred to a gap between the rotor cylinder portion 45 and the outer circumference side stator 70 and, thereafter, compressed in the outer-circumference-side thread groove portion 71 and transferred to the gas outlet port 11*a*. Alternatively, the gas is transferred to a gap between the rotor cylinder portion 45 and the inner circumference side stator 80 via connection holes 46 and, thereafter, compressed in the inner-circumference-side thread groove portion 81 and transferred to the gas outlet port 11*a*.

A gas exhaust flow rate Q1 of the outer-circumference-side thread groove portion 71 and a gas exhaust flow rate Q2 of the inner-circumference-side thread groove portion 81 are set to satisfy, for example, a relation of Q1:Q2=2 to 3:1. The gas exhaust amount Q1 of the outer-circumference-side thread groove portion 71 is a product of exhaust speed and a channel sectional area of the outer-circumference-side thread groove portion 71 explained below. The gas exhaust flow rate Q2 of the inner-circumference-side thread groove portion 81 is a product of the exhaust speed and a channel sectional area of the inner-circumference-side thread groove portion 81 explained below.

Next, a specific configuration of the outer circumference side stator 70 is explained with reference to FIGS. 2A to 2C.

The outer circumference side stator 70 includes a plurality of outer-circumference-side thread groove portions 71 provided along a gas exhaust direction D1 and a plurality of outer-circumference-side thread ridge portions 72 extended among the outer-circumference-side thread groove portions 71.

The outer-circumference-side thread groove portion 71 is formed at an equal width of a root width A1 from the intake side to the exhaust side along the gas exhaust direction D1. An inner diameter in the outer-circumference-side thread groove portion 71 is set to be smaller on the exhaust side than on the intake side of the gas. A channel sectional area S1 of the outer-circumference-side thread groove portion 71 perpendicular to the gas exhaust direction D1 is represented by a product of the root width A1 of the outer-circumference-side thread groove portion 71 and height H1 of the outer-circumference-side thread ridge portion 72.

The outer-circumference-side thread ridge portion 72 is formed at an equal width of a ridge width B1 from the intake side to the exhaust side along the gas exhaust direction D1. The number of ridges of the outer-circumference-side thread ridge portion 72 is set to five. A lead angle θ1 of the outer-circumference-side thread ridge portion 72 is set to 15°.

A seal length L1 for one ridge of the outer-circumference-side thread ridge portion 72, that is, the length in the up-down direction H of the outer-circumference-side thread ridge portion 72 is as indicated by a relational expression described below.

$$L1=B1/\cos\theta 1 \quad (1)$$

A ratio (A1/B1) of the root width A1 of the outer-circumference-side thread groove portion 71 and the ridge width B1 of the outer-circumference-side thread ridge portion 72 is set to 5. Note that the ratio of the root width A1 of the outer-circumference-side thread groove portion 71 and the ridge width B1 of the outer-circumference-side thread ridge portion 72 may be adjusted as appropriate in a range in which the outer-circumference-side thread groove portion 71 can smoothly compress and exhaust the gas while having a desired compression ratio. The ratio may be smaller than 5 or may be larger than 5.

Next, a specific configuration of the inner circumference side stator 80 is explained with reference to FIGS. 3A to 3C.

The inner circumference side stator 80 includes a plurality of inner-circumference-side thread groove portions 81 provided along a gas exhaust direction D2 and a plurality of inner-circumference-side thread ridge portions 82 extended among the inner-circumference-side thread groove portions 81.

The inner-circumference-side thread groove portion 81 is formed at an equal width of a root width A2 from the intake side to the exhaust side along the gas exhaust direction D2. An outer diameter in the inner-circumference-side thread groove portion 81 is set to be smaller on the intake side than on the exhaust side of the gas. A channel sectional area S2 of the inner-circumference-side thread groove portion 81 perpendicular to the gas exhaust direction D2 is represented by a product of the root width A2 of the inner-circumference-side thread groove portion 81 and height H2 of the inner-circumference-side thread ridge portion 82.

The inner-circumference-side thread ridge portion 82 is formed at an equal width of a ridge width B2 from the intake side to the exhaust side along the gas exhaust direction D2. The number of ridges of the inner-circumference-side thread ridge portion 82 is set to six. A lead angle θ2 of the inner-circumference-side thread ridge portion 82 is set to 10°.

A seal length L2 for one ridge of the inner-circumference-side thread ridge portion 82, that is, the length in the up-down direction H of the inner-circumference-side thread ridge portion 82 is as indicated by a relational expression described below.

$$L2=B2/\cos\theta 2 \quad (2)$$

A ratio (A2/B2) of the root width A2 of the inner-circumference-side thread groove portion 81 and the ridge width B2 of the inner-circumference-side thread ridge portion 82 is set to 2. Note that the ratio of the root width A2 of the inner-circumference-side thread groove portion 81 and the ridge width B2 of the inner-circumference-side thread ridge portion 82 may be adjusted as appropriate in a range in which the inner-circumference-side thread groove portion 81 can smoothly compress and exhaust the gas while having a desired compression ratio. The radio may be smaller than 2 or may be larger than 2.

In Expressions (1) and (2), usually, the influence of a difference between cos θ1 and cos θ2 on the sizes of the seal length L1 of the outer-circumference-side thread groove portion 71 and the seal length L2 of the inner-circumference-side thread groove portion 81 is small. The sizes of the seal length L1 of the outer-circumference-side thread groove portion 71 and the seal length L2 of the inner-circumference-side thread groove portion 81 depend on the sizes of the ridge width B1 of the outer-circumference-side thread ridge portion 72 and the ridge width B2 of the inner-circumference-side thread ridge portion 82.

In the exhaust-performance improving means, the ratio (A2/B2) of the root width A2 of the inner-circumference-side thread groove portion 81 and the ridge width B2 of the inner-circumference-side thread ridge portion 82 is set to be smaller than the ratio (A1/B1) of the root width A1 of the outer-circumference-side thread groove portion 71 and the ridge width B1 of the outer-circumference-side thread ridge portion 72. Consequently, since the ridge width B2 of the inner-circumference-side thread ridge portion 82 is larger than the ridge width B1 of the outer-circumference-side thread ridge portion 72, the seal length L2 of the inner-circumference-side thread ridge portion 82 is larger than the seal length L1 of the outer-circumference-side thread ridge portion 72. Therefore, sealability between the rotor cylinder portion 45 and the inner-circumference-side thread ridge portion 82 is higher than sealability between the rotor cylinder portion 45 and the outer-circumference-side thread ridge portion 72, whereby a backflow of the gas in the thread groove pump mechanism PB is suppressed.

The ratio (A2/B2) of the root width A2 of the inner-circumference-side thread groove portion 81 and the ridge width B2 of the inner-circumference-side thread ridge portion 82 is set to be smaller than the ratio (A1/B1) of the root width A1 of the outer-circumference-side thread groove portion 71 and the ridge width B1 of the outer-circumference-side thread ridge portion 72. Therefore, since the root width A2 of the inner-circumference-side thread groove portion 81 is smaller than the root width A1 of the outer-circumference-side thread groove portion 71, the channel sectional area S2 of the inner-circumference-side thread groove portion 81 is smaller than the channel sectional area S1 of the outer-circumference-side thread groove portion 71. The gas in the inner-circumference-side thread groove portion 81 is easily compressed. Consequently, even when a channel of the inner-circumference-side thread groove portion 81 is shorter than a channel of the outer-circumference-side thread groove portion 71, a pressure difference between an outlet pressure of the outer-circumference-side thread groove portion 71 and an outlet pressure of the inner-circumference-side thread groove portion 81 is reduced.

A ratio ((A2/B2)/(A1/B1)) of the ratio (A2/B2) of the root width A2 of the inner-circumference-side thread groove portion 81 and the ridge width B2 of the inner-circumference-side thread ridge portion 82 and the ratio (A1/B1) of the root width A1 of the outer-circumference-side thread groove portion 71 and the ridge width B1 of the outer-circumference-side thread ridge portion 72 is set to substantially coincide with a ratio (Q1/Q2) of the gas exhaust flow rate Q1 of the outer-circumference-side thread groove portion 71 and the gas exhaust flow rate Q2 of the inner-circumference-side thread groove portion 81.

Consequently, the seal length L2 of the inner-circumference-side thread ridge portion 82 is secured, and sealability between the rotor cylinder portion 45 and the inner circumference side stator 80 is improved. The channel sectional area S1 of the outer-circumference-side thread groove portion 71 and the channel sectional area S2 of the inner-circumference-side thread groove portion 81 are set according to the gas exhaust flow rate Q1 of the outer-circumference-side thread groove portion 71 and the gas exhaust flow rate Q2 of the inner-circumference-side thread groove portion 81 such that the gas is surely distributed to the outer-circumference-side thread groove portion 71 and the inner-circumference-side thread groove portion 81. Therefore, the outer-circumference-side thread groove portion 71 and the inner-circumference-side thread groove portion 81 can smoothly compress and exhaust the gas.

Note that "substantially coincide" is not limited to the case in which the ratio ((A2/B2)/(A1/B1)) of the ratio (A2/B2) of the root width A2 of the inner-circumference-side thread groove portion 81 and the ridge width B2 of the inner-circumference-side thread ridge portion 82 and the ratio (A1/B1) of the root width A1 of the outer-circumference-side thread groove portion 71 and the ridge width B1 of the outer-circumference-side thread ridge portion 72 and the ratio (Q1/Q2) of the gas exhaust flow rate Q1 of the outer-circumference-side thread groove portion 71 and the gas exhaust flow rate Q2 of the inner-circumference-side thread groove portion 81 completely coincide with each other and includes the case in which the ratios are different within a range allowed by requested specifications.

Note that the ratio (A2/B2) of the root width A2 of the inner-circumference-side thread groove portion 81 and the ridge width B2 of the inner-circumference-side thread ridge portion 82, and the ratio (A1/B1) of the root width A1 of the outer-circumference-side thread groove portion 71 and the ridge width B1 of the outer-circumference-side thread ridge portion 72 desirably satisfy a relational expression described below.

$$(A1/B1)/(A2/B2) \leq 3 \quad (3)$$

Consequently, it is possible to suppress, while securing the seal length L2 of the inner-circumference-side thread ridge portion 82, the gas exhaust flow rate Q2 of the inner-circumference-side thread groove portion 81 from becoming excessively small.

Further, the ratio (A2/B2) of the root width A2 of the inner-circumference-side thread groove portion 81 and the ridge width B2 of the inner-circumference-side thread ridge portion 82, and the ratio (A1/B1) of the root width A1 of the outer-circumference-side thread groove portion 71 and the ridge width B1 of the outer-circumference-side thread ridge portion 72 desirably satisfy a relational expression described below.

$$2 \leq (A1/B1)/(A2/B2) \quad (4)$$

Consequently, it is possible to secure, while securing the seal length L2 of the inner-circumference-side thread ridge portion 82, the root width A2 of the inner-circumference-side thread groove portion 81 large. Therefore, the inner-circumference-side thread groove portion 81 can smoothly compress and exhaust the gas.

In this way, in the thread groove pump mechanism PB according to this embodiment, the sealability between the rotor cylinder portion 45 and the inner circumference side stator 80 increases, whereby a decrease in the gas exhaust amount Q2 of the inner-circumference-side thread groove portion 81 due to a backflow of the gas in the thread groove pump mechanism PB is suppressed. In addition, a pressure difference in the pump radial direction R near the outlet of the thread groove pump mechanism PB is reduced, and the inner-circumference-side thread groove portion 81 easily compresses and exhausts the gas. As a result, it is possible to improve the exhaust performance and the compression performance of the co-flow thread groove pump mechanism PB.

Next, a vacuum pump including a thread groove pump mechanism according to a second embodiment of the present invention is explained with reference to FIGS. 4 to 9.

Note that the vacuum pump including the thread groove pump mechanism according to this embodiment and the vacuum pump including the thread groove pump mechanism according to the first embodiment are different in the configuration of an exhaust-performance improving means. The other components are the same. Therefore, members same as the members of the vacuum pump including the thread groove pump mechanism according to the first embodiment are denoted by the same reference numerals and signs. Redundant explanation of the members is omitted.

First, the specific configuration of the outer circumference side stator 70 of the thread groove pump mechanism PB according to this embodiment is explained with reference to FIGS. 5A to 5C.

Gas exhaust speed of the plurality of the outer-circumference-side thread groove portions 71 is set to 50 L/s in total. Therefore, when an intake side pressure is 0.1 Torr, a gas exhaust total flow rate of the plurality of the outer-circumference-side thread groove portions 71 is set to 400 cc/min. The gas exhaust speed of the plurality of the outer-circumference-side thread groove portions 71 is obtained by calculating products of the groove depth D1 of the outer-circumference-side thread groove portion 71, the width W1 of the outer-circumference-side thread groove portion 71, and transfer speed of the gas in the outer-circumference-side thread groove portions 71 and adding up values of the products of the outer-circumference-side thread groove portions 71. The gas exhaust total flow rate of the plurality of the outer-circumference-side thread groove portions 71 is a product of the gas exhaust speed of the plurality of the outer-circumference-side thread groove portions 71 and the intake side pressure of the outer-circumference-side thread groove portion 71.

Five outer-circumference-side thread ridge portions 72 are provided on the inner circumferential surface 70*a* of the outer circumference side stator 70. An angle of elevation θ3 of the outer-circumference-side thread ridge portions 72 is set to 18°.

The specific configuration of the inner circumference side stator 80 is explained with reference to FIGS. 6A to 6C.

Gas exhaust speed of the plurality of the inner-circumference-side thread groove portions 81 is set to 40 L/s in total. Therefore, when an intake side pressure is 0.1 Torr, a gas exhaust total flow rate of the plurality of the inner-circumference-side thread groove portions 81 is set to 300 cc/min. The gas exhaust speed of the plurality of the inner-circumference-side thread groove portions 81 is obtained by calculating products of the groove depth D2 of the inner-circumference-side thread groove portion 81, the width W2 of the inner-circumference-side thread groove portion 81, and transfer speed of the gas in the inner-circumference-side thread groove portions 81 and adding up values of the products of the inner-circumference-side thread groove portions 81. The gas exhaust total flow rate of the plurality of the inner-circumference-side thread groove portions 81 is a product of the gas exhaust speed of the plurality of the inner-circumference-side thread groove portions 81 and the intake side pressure of the inner-circumference-side thread groove portion 81. The groove depth D2 of the inner-circumference-side thread groove portion 81 is set to be smaller than the groove depth D1 of the outer-circumference-side thread groove portion 71. That is, the inner-circumference-side thread groove portion 81 is formed shallower than the outer-circumference-side thread groove portion 71.

A total inlet area of the plurality of the inner-circumference-side thread groove portions 81, that is, a sum of sectional areas (products of the groove depth D2 and the width W2) of the inner-circumference-side thread groove portions 81 in five rows is set to be larger than a total opening area of the connection holes 46, that is, a sum of the areas of the plurality of the connection holes 46 provided in the rotor cylinder portion 45.

Consequently, the gas smoothly flows into the intake side of the inner-circumference-side thread groove portion 81 via the connection holes 46. Therefore, it is possible to suppress an excessive pressure rise on the intake side of the inner-circumference-side thread groove portion 81.

The number of ridges of the inner-circumference-side thread ridge portion 82 is set to six, which is larger than the number of ridges of the outer-circumference-side thread ridge portion 72. An angle of elevation θ4 of the inner-circumference-side thread ridge portion 82 is set to 10°, which is smaller than the angle of elevation θ3 of the outer-circumference-side thread ridge portion 72.

Consequently, whereas the outer-circumference-side thread ridge portion 72 traverses four imaginary lines V1 parallel to the up-down direction H, the inner-circumference-side thread ridge portion 82 traverses five imaginary lines V2 parallel to the up-down direction H. Therefore, the inner-circumference-side thread ridge portion 82 traverses approximately 1.25 times more than the outer-circumference-side thread ridge portion 72 and more efficiently compresses and transfers the gas than the outer-circumference-side thread ridge portion 72.

Figure 8:
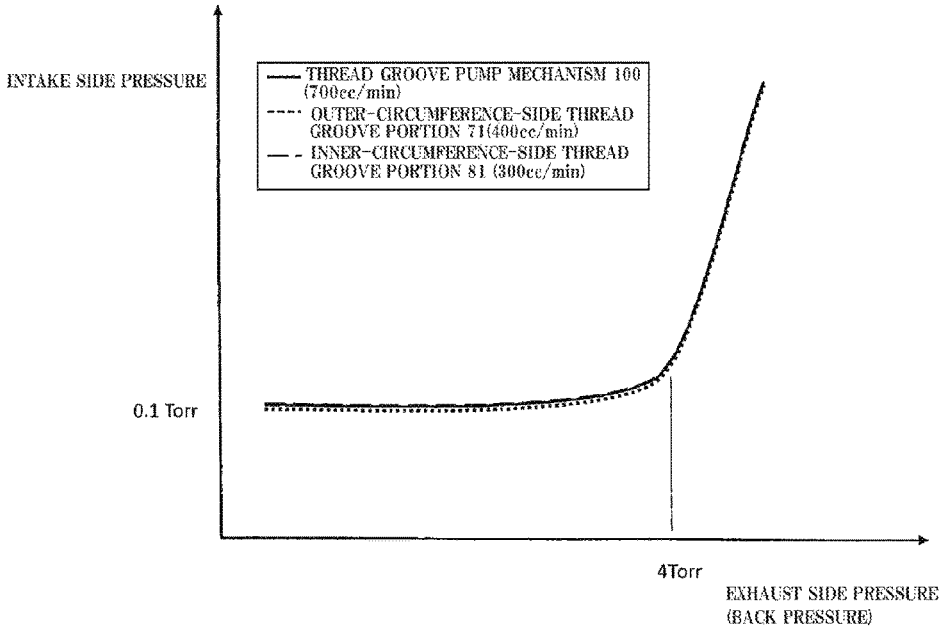
FIG. 8 is a diagram showing a back pressure characteristic of a co-flow thread groove pump mechanism used in the vacuum pump shown in FIG. 4.
Figure 9:
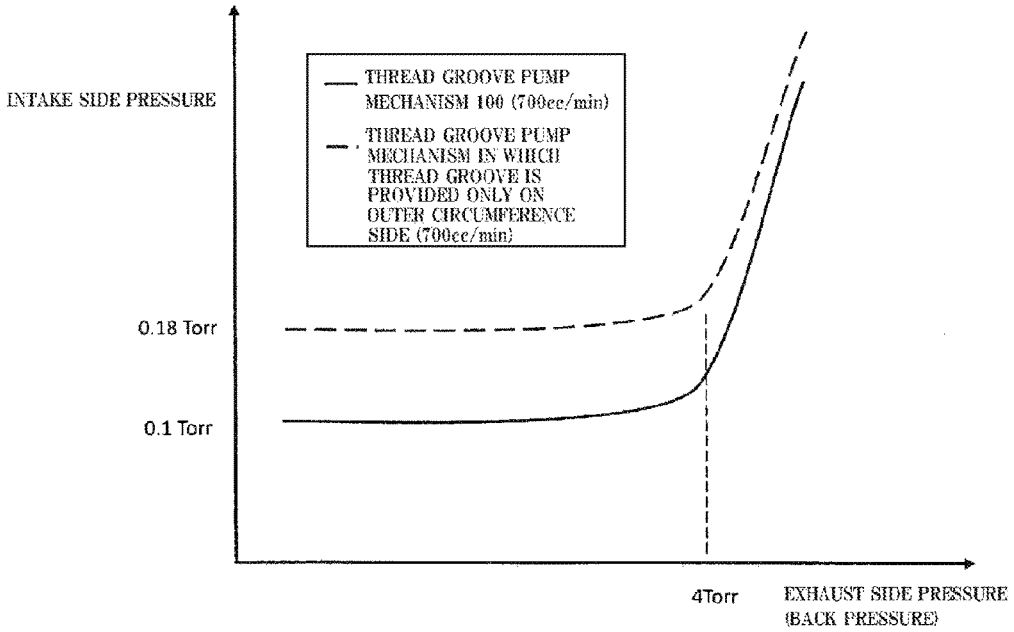
FIG. 9 is a diagram showing back pressure characteristics of the thread groove pump mechanism shown in FIG. 8 and a thread groove pump mechanism including one row of a thread groove portion.
Figure 10:
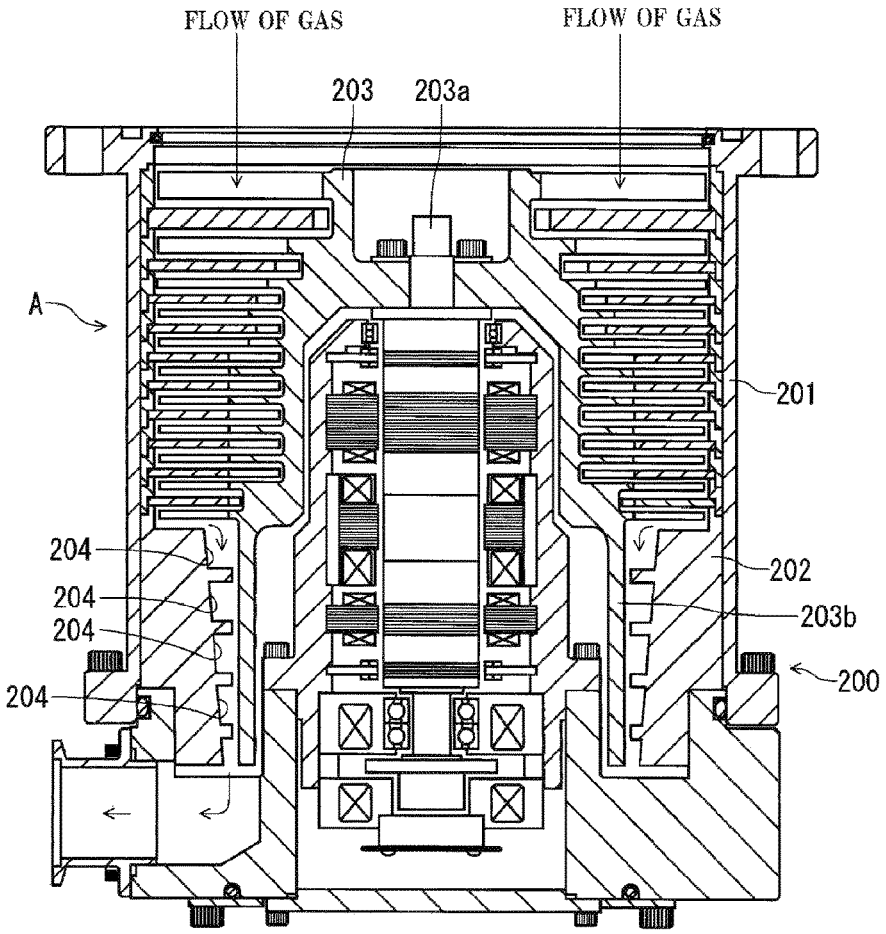
FIG. 10 is a schematic diagram showing a vacuum pump according to a conventional example.
Figure 11:
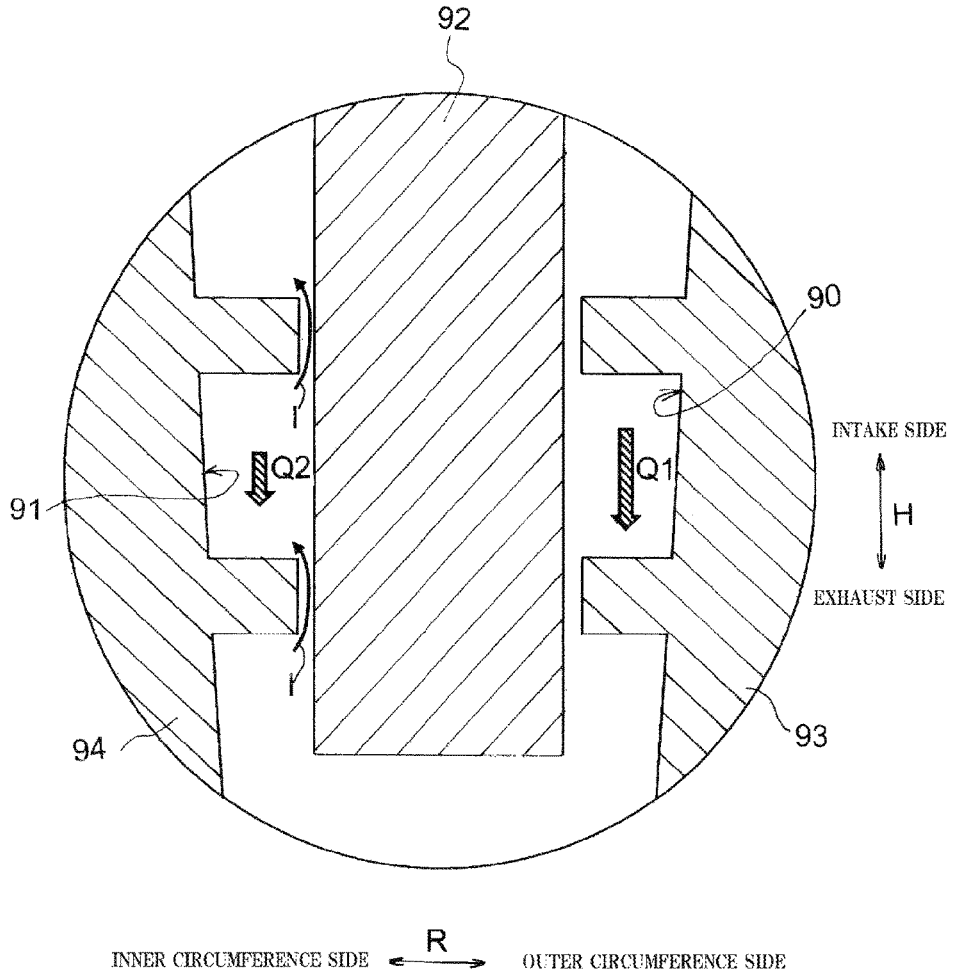
FIG. 11 is a schematic diagram showing a main part of a co-flow thread groove pump mechanism applied to a vacuum pump according to another conventional example.
Figure 12:
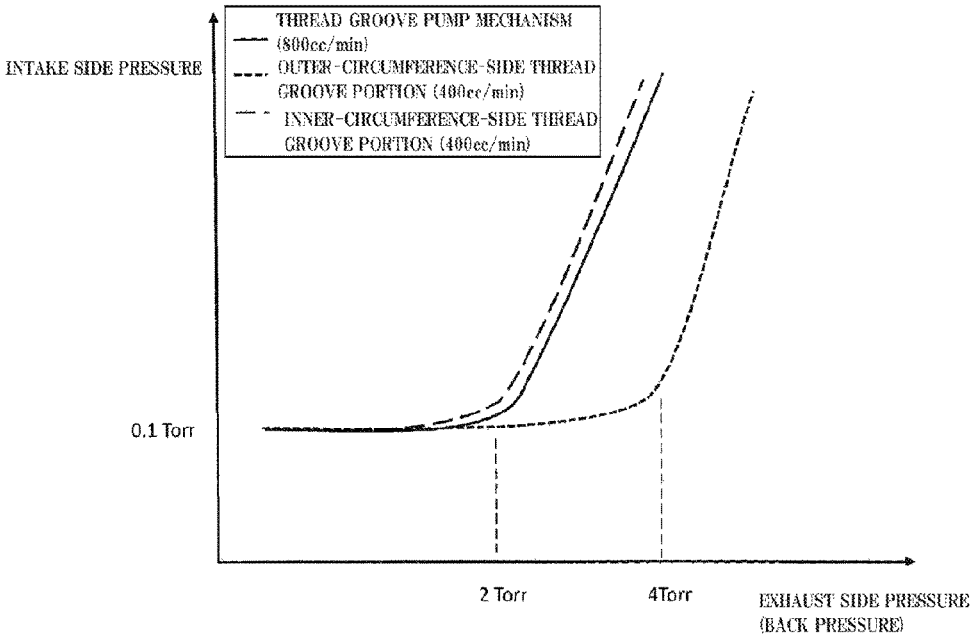
FIG. 12 is a diagram showing back pressure characteristics of a conventional outer-circumference-side thread groove portion and a conventional inner-circumference-side thread groove portion and a co-flow thread groove pump mechanism including the outer-circumference-side thread groove portion and the inner-circumference-side thread groove portion.
Figure 13:
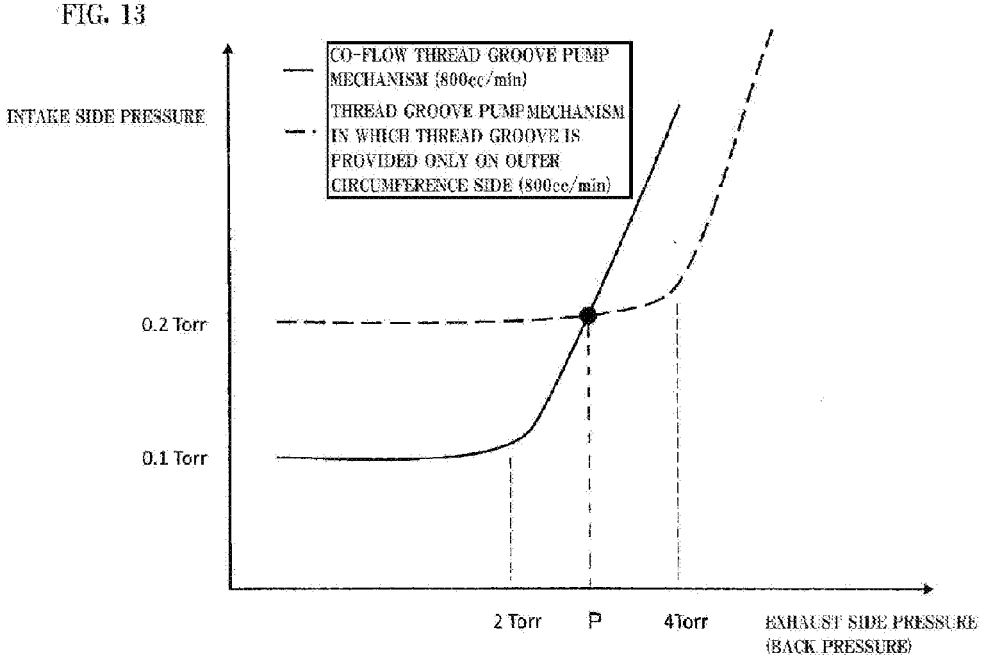
FIG. 13 is a diagram showing back pressure characteristics of the co-flow thread groove pump mechanism shown in FIG. 12 and a thread groove pump mechanism including one row of a thread groove portion.

Next, the exhaust-performance improving means configured by setting a back pressure characteristic of the outer-circumference-side thread groove portion 71 and a back pressure characteristic of the inner-circumference-side thread groove portion 81 substantially equal is explained with reference to FIGS. 7 to 9. The "back pressure characteristic" indicates a relation between an intake side pressure and an exhaust side pressure (a back pressure) as shown in FIGS. 7 to 9.

In the inner-circumference-side thread groove portion used in the conventional co-flow thread groove pump mechanism, parameters (the number of ridges, an angle of elevation, a groove depth, etc.) are set the same as the parameters of the outer-circumference-side thread groove portion. On the other hand, the inner-circumference-side thread groove portion 81 is set to the parameters different from the parameters of the outer-circumference-side thread groove portion 71.

Specifically, in the inner-circumference-side thread groove portion 81, the number of ridges (six) of the inner-circumference-side thread ridge portion 82 is set to be larger than the number of ridges (five) of the outer-circumference-side thread ridge portion 72. The angle of elevation (10°) of the inner-circumference-side thread ridge portion 82 is set to be smaller than the angle of elevation (18°) of the outer-circumference-side thread ridge portion 72. A clearance C2 between the inner circumferential surface 45*b* of the rotor cylinder portion 45 and the inner-circumference-side thread ridge portion 82 is set to be smaller than a clearance C1 between the outer circumferential surface 45*a* of the rotor cylinder portion 45 and the outer-circumference-side thread ridge portion 72.

Figure 7:
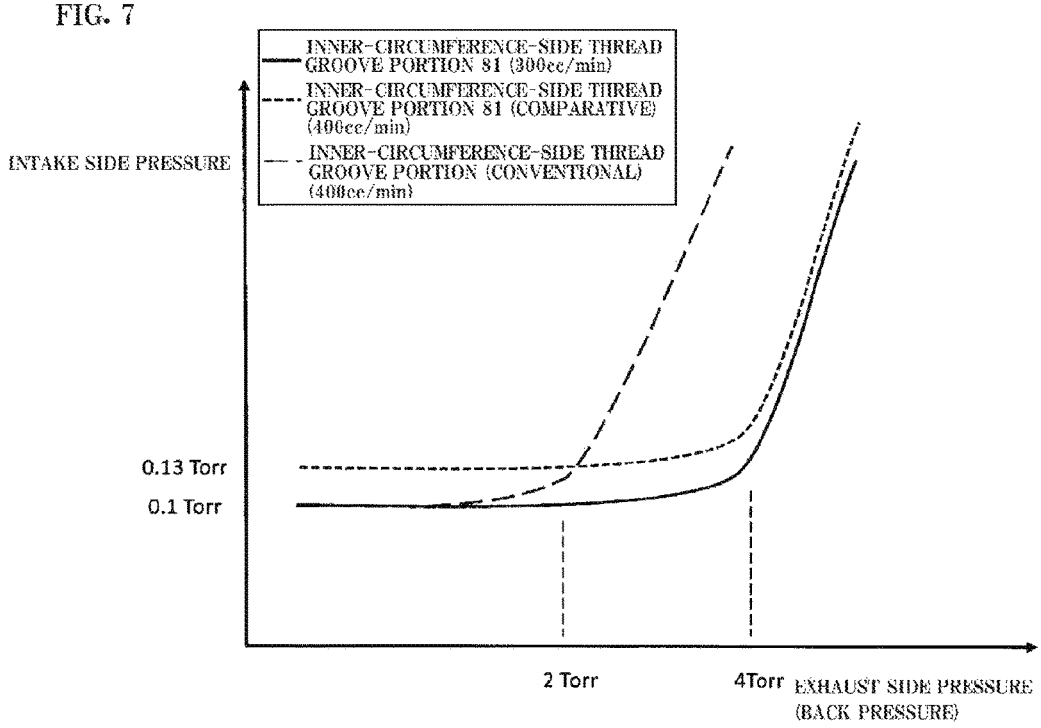
FIG. 7 is a diagram showing a back pressure characteristic of an inner-circumference-side thread groove portion used in the vacuum pump shown in FIGS. 6A to 6C.

The back pressure characteristic of the inner-circumference-side thread groove portion 81 is indicated by a solid line in FIG. 7. The back pressure characteristic of the conventional inner-circumference-side thread groove portion is indicated by a long dashed line in FIG. 7. Further, a back pressure characteristic in exhausting the gas by a gas exhaust flow rate of 400 cc/min using the inner-circumference-side thread groove portion 81 is indicated by a short dashed line in FIG. 7 as a comparative example.

As shown in FIG. 7, when the gas is exhausted by the gas exhaust flow rate of 400 cc/min using the inner-circumference-side thread groove portion 81 in the same manner as in the conventional inner-circumference-side thread groove portion, the intake side pressure rises to 0.13 Torr. Therefore, when the intake side pressure of the inner-circumference-side thread groove portion 81 is set to 0.1 Torr, the gas exhaust flow rate of the inner-circumference-side thread groove portion 81 is reduced to 300 cc/min. That is, when exhaust performance in the case of a low exhaust side pressure is compared in the inner-circumference-side thread groove portion 81 and the conventional inner-circumference-side thread groove portion, the exhaust performance is worse in the former than in the latter. However, whereas, in the latter, the exhaust side pressure that can be increased to 2 Torr in a state in which the intake side pressure is maintained, in the former, the exhaust side pressure can be increased to 4 Torr in the state in which the intake side pressure is maintained. Therefore, the compression performance is improved.

As shown in FIG. 8, the back pressure characteristic of the inner-circumference-side thread groove portion 81 (having the gas exhaust flow rate of 300 cc/min) substantially coincides with the back pressure characteristic of the outer-circumference-side thread groove portion 71 (having the gas exhaust flow rate of 400 cc/min). Note that "substantially equal" is not limited to the case in which the back pressure characteristic of the outer-circumference-side thread groove portion 71 and the back pressure characteristic of the inner-circumference-side thread groove portion 81 completely coincide with each other and includes the case in which the back pressure characteristics are different within a range allowed by requested specifications.

The thread groove pump mechanism PB (having the gas exhaust flow rate of 700 cc/min) including the outer-circumference-side thread groove portion 71 and the inner-circumference-side thread groove portion 81 shows a back pressure characteristic substantially coinciding with the back pressure characteristic of the outer-circumference-side thread groove portion 71 (having the gas exhaust flow rate of 400 cc/min) and the back pressure characteristic of the inner-circumference-side thread groove portion 81 (having the gas exhaust flow rate of 300 cc/min).

As shown in FIG. 9, when the thread groove pump mechanism PB and the conventional thread groove pump mechanism (having the gas exhaust flow rate of 700 cc/min) in which the thread groove portion is provided only on the outer circumference side are compared, it is seen that, whereas the intake side pressure of the former is 0.1 Torr, the intake side pressure of the latter is 0.18 Torr, the former can be operated at a lower pressure than the latter, the intake side pressure of the former is lower than the intake side pressure of the latter from a low back pressure region to a high back pressure region, and the former shows exhaust performance and compression performance more excellent than the exhaust performance and the compression performance of the latter.

In this way, in the thread groove pump PB according to this embodiment, the back pressure characteristic of the outer-circumference-side thread groove portion 71 and the back pressure characteristic of the inner-circumference-side thread groove portion 81 are set to be substantially equal. Therefore, a backflow of the gas between the outer-circumference-side thread groove portion 71 and the inner-circumference-side thread groove portion 81 on the intake side of the thread groove pump mechanism PB due to inconsistency of the intake side pressure of the outer-circumference-side thread groove portion 71 and the intake side pressure of the inner-circumference-side thread groove portion 81 is suppressed. A backflow of the gas between the outer-circumference-side thread groove portion 71 and the inner-circumference-side thread groove portion 81 on the exhaust side of the thread groove pump mechanism PB due to inconsistency of the exhaust side pressure of the outer-circumference-side thread groove portion 71 and the exhaust side pressure of inner-circumference-side thread groove portion 81 is suppressed. Consequently, since the outer-circumference-side thread groove portion 71 and the inner-circumference-side thread groove portion 81 respectively surely function from the low back pressure region to the high back pressure region, it is possible to improve the exhaust performance and the compression performance of the co-flow thread groove pump mechanism PB.

Note that the means for setting the back pressure characteristic of the outer-circumference-side thread groove portion 71 and the back pressure characteristic of the inner-circumference-side thread groove portion 81 may be any means as long as the back pressure characteristics can be set to be substantially equal. Besides a means for adjusting the parameters (the number of ridges, the angle of elevation, the groove depth, the clearance, etc.) of the inner-circumference-side thread groove portion 81 according to the back pressure characteristic of the outer-circumference-side thread groove portion 71, the means for setting the back pressure characteristics may be a means for adjusting the parameters of the outer-circumference-side thread groove portion 71 according to the back pressure characteristic of the inner-circumference-side thread groove portion 81 or a means for adjusting the parameters of the outer-circumference-side thread groove portion 71 and the inner-circumference-side thread groove portion 81 to match any back pressure characteristic.

In the embodiments, the outer-circumference-side thread groove portion is provided on the inner circumferential surface of the outer circumference side stator. However, the outer-circumference-side thread groove portion may be provided on the outer circumferential surface of the rotor cylinder portion. In the embodiments, the inner-circumference-side thread groove portion is provided on the outer circumferential surface of the inner circumference side stator. However, the inner-circumference-side thread groove portion may be provided on the inner circumferential surface of the rotor cylinder portion.

The present invention is applicable to any pump as long as the pump includes the thread groove pump mechanism. Besides the combination pump, the present invention may be applied to a thread-groove type pump. Further, the present invention is not limited to the pump in which only one rotor cylinder portion is provided and may be applied to, for example, a pump in which a plurality of rotor cylinder portions are coaxially provided and thread groove portions are engraved in at least one of the rotor cylinder portions and a stator opposed to the rotor cylinder portions.

Note that the present invention can be variously modified without departing from the spirit of the present invention. Naturally, the present invention covers the modified inventions.

Although the subject matter has been described in language specific to structural features and/or methodological acts, it is to be understood that the subject matter defined in the appended claims in not necessarily limited to the specific features or acts described above. Rather, the specific features and acts described above are described as example forms of implementing the claims.

What is claimed is:

1. A co-flow thread groove pump mechanism comprising:

a rotor cylinder portion rotatable in a predetermined rotating direction;

an outer circumference side stator having a substantially cylindrical shape and disposed coaxially with the rotor cylinder portion on an outer circumference side of the rotor cylinder portion;

an inner circumference side stator having a substantially cylindrical shape and disposed coaxially with the rotor cylinder portion on an inner circumference side of the rotor cylinder portion;

an outer-circumference-side thread groove portion engraved on one of opposite surfaces of the rotor cylinder portion and the outer circumference side stator; and an inner-circumference-side thread groove portion engraved on one of opposite surfaces of the rotor cylinder portion and the inner circumference side stator, wherein a configuration of the outer-circumference-side thread groove portion differs from a configuration of the inner-circumference-side thread groove portion such that an exhaust side pressure of the outer-circumference-side thread groove portion is set to be substantially equal to an exhaust side pressure of the inner-circumference-side thread groove portion.

2. The co-flow thread groove pump mechanism according to claim 1, wherein the rotor cylinder portion is provided in a rotor, and a ratio of a root width of the inner-circumference-side thread groove portion and a ridge width of an inner-circumference-side thread ridge portion extended between the inner-circumference-side thread groove portions is set to be smaller than a ratio of a root width of the outer-circumference-side thread groove portion and a ridge width of an outer-circumference-side thread ridge portion extended between the outer-circumference-side thread groove portions.

3. The co-flow thread groove pump mechanism according to claim 2, wherein a ratio of the ratio of the root width of the inner-circumference-side thread groove portion and the ridge width of the inner-circumference-side thread ridge portion and the ratio of the root width of the outer-circumference-side thread groove portion and the ridge width of the outer-circumference-side thread ridge portion substantially coincides with a ratio of a gas exhaust flow rate of the outer-circumference-side thread groove portion and a gas exhaust flow rate of the inner-circumference-side thread groove portion.

4. The co-flow thread groove pump mechanism according to claim 2, wherein the ratio of the root width of the inner-circumference-side thread groove portion and the ridge width of the inner-circumference-side thread ridge portion, and the ratio of the root width of the outer-circumference-side thread groove portion and the ridge width of the outer-circumference-side thread ridge portion satisfy a relational expression described below:

$$(A1/B1)/(A2/B2) \leq 3$$

A1: the root width of the outer-circumference-side thread groove portion

B1: the ridge width of the outer-circumference-side thread ridge portion

A2: the root width of the inner-circumference-side thread groove portion

B2: the ridge width of the inner-circumference-side thread ridge portion.

5. The co-flow thread groove pump mechanism according to claim 2, wherein the ratio of the root width of the inner-circumference-side thread groove portion and the ridge width of the inner-circumference-side thread ridge portion, and the ratio of the root width of the outer-circumference-side thread groove portion and the ridge width of the outer-circumference-side thread ridge portion satisfy a relational expression described below:

$$2 \leq (A1/B1)/(A2/B2)$$

A1: the root width of the outer-circumference-side thread groove portion

B1: the ridge width of the outer-circumference-side thread ridge portion

A2: the root width of the inner-circumference-side thread groove portion

B2: the ridge width of the inner-circumference-side thread ridge portion.

6. The co-flow thread groove pump mechanism according to claim 1, wherein a plurality of the outer-circumference-side thread groove portions are engraved on at least one of an outer circumferential surface of the rotor cylinder portion and an opposite surface of the outer circumference side stator opposed to the outer circumferential surface of the rotor cylinder portion, a plurality of the inner-circumference-side thread groove portions are engraved on at least one of an inner circumferential surface of the rotor cylinder portion and an opposite surface of the inner circumference side stator opposed to the inner circumferential surface of the rotor cylinder portion, and a back pressure characteristic indicating a relation between an intake side pressure and an exhaust side pressure is set to be substantially equal for the plurality of the outer-circumference-side thread groove portions and the plurality of the inner-circumference-side thread groove portions.

7. The co-flow thread groove pump mechanism according to claim 6, wherein an angle of elevation of an inner-circumference-side thread ridge portion extended between the plurality of the inner-circumference-side thread groove portions is set to be smaller than an angle of elevation of an outer-circumference-side thread ridge portion extended between the plurality of the outer-circumference-side thread groove portions.

8. The co-flow thread groove pump mechanism according to claim 6, wherein the number of ridges of an inner-circumference-side thread ridge portion extended between the plurality of the inner-circumference-side thread groove portions is set to be larger than the number of ridges of an outer-circumference-side thread ridge portion extended between the plurality of the outer-circumference-side thread groove portions.

9. The co-flow thread groove pump mechanism according to claim 6, wherein a groove depth of the inner-circumference-side thread groove portion is set to be smaller than a groove depth of the outer-circumference-side thread groove portion.

10. The co-flow thread groove pump mechanism according to claim 6, wherein a clearance between an inner-circumference-side thread ridge portion extended between the plurality of the inner-circumference-side thread groove portions and the inner circumference side stator or the rotor cylinder portion is set to be smaller than a clearance between an outer-circumference-side thread ridge portion extended between the plurality of the outer-circumference-side thread groove portions and the outer circumference side stator or the rotor cylinder portion.

11. The co-flow thread groove pump mechanism according to claim 6, wherein a total inlet area of the plurality of the inner-circumference-side thread groove portions is set to be larger than a total opening area of connection holes drilled in the rotor cylinder portion.

12. A vacuum pump comprising the co-flow thread groove pump mechanism according to claim 1.

13. A rotor used in the co-flow thread groove pump mechanism according to claim 1.

14. The rotor according to claim 13, wherein a ratio of a root width of the outer-circumference-side thread groove portion and a ridge width of an outer-circumference-side thread ridge portion extended between the outer-circumference-side thread groove portions is set to be larger than a ratio of a root width of the inner-circumference-side thread groove portion engraved on one of the opposite surfaces of the rotor cylinder portion and the inner circumference side stator and a ridge width of an inner-circumference-side thread ridge portion extended between the inner-circumference-side thread groove portions.

15. An outer circumference side stator used in the co-flow thread groove pump mechanism according to claim 1.

16. The outer circumference side stator according to claim 15, wherein a ratio of a root width of the outer-circumference-side thread groove portion and a ridge width of an outer-circumference-side thread ridge portion extended between the outer-circumference-side thread groove portions is set to be larger than a ratio of a root width of the inner-circumference-side thread groove portion engraved on one of the opposite surfaces of the rotor cylinder portion and the inner circumference side stator and a ridge width of an inner-circumference-side thread ridge portion extended between the inner-circumference-side thread groove portions.

17. An inner circumference side stator used in the co-flow thread groove pump mechanism according to claim 1.

* * * * *